US006600270B2

(12) United States Patent
Belliveau

(10) Patent No.: US 6,600,270 B2
(45) Date of Patent: Jul. 29, 2003

(54) METHOD AND APPARATUS FOR GENERATING A FLASH OR SERIES OF FLASHES FROM A MULTIPARAMETER LIGHT

(76) Inventor: Richard S. Belliveau, 10643 Floral Park, Austin, TX (US) 78759

( * ) Notice: Subject to any disclaimer, the term of this patent is extended or adjusted under 35 U.S.C. 154(b) by 17 days.

(21) Appl. No.: 09/858,195

(22) Filed: May 14, 2001

(65) Prior Publication Data

US 2002/0070680 A1 Jun. 13, 2002

Related U.S. Application Data

(60) Provisional application No. 60/280,613, filed on Mar. 29, 2001, provisional application No. 60/248,998, filed on Nov. 14, 2000, and provisional application No. 60/204,250, filed on May 15, 2000.

(51) Int. Cl.[7] ..... H05B 37/00

(52) U.S. Cl. ..... 315/200 A; 315/241 P; 315/241 S; 362/321; 340/825.73; 340/870.26

(58) Field of Search ..... 315/200 A, 241 P, 315/241 S; 362/321, 317, 335; 340/870.26, 825.71, 825.73

(56) References Cited

U.S. PATENT DOCUMENTS

| | | | | |
|---|---|---|---|---|
| 4,392,187 A | | 7/1983 | Bornhorst | 362/233 |
| 5,351,106 A | * | 9/1994 | Lesko et al. | 355/83 |
| 5,788,365 A | * | 8/1998 | Hunt et al. | 362/301 |
| 6,002,467 A | * | 12/1999 | Nishi et al. | 355/61 |
| 6,331,813 B1 | * | 12/2001 | Belliveau | 315/312 |

OTHER PUBLICATIONS

Advanced Radiation Corporation; Products & Applications Page; *http://www.arc–lamps.com/products.html*; Nov. 10, 2000.

High End Systems Inc., High End Product Line 2000 Catalog.

Kent, Raymond A., A Spin Around Moving Lights, *www.siue.edu/–rkent*, pp. ii and 149–156, 1999.

Philips Lighting Company, Product Catalog, *www.lighting-.philip.com/nam/catalog/toc.shtml*, p. 111, 2001.

Space Cannon vH Illumination Inc., EASY 2000/2500/3000 Outdoor Xenon Searchlight, (date unknown).

High End Systems, X–Spot Automated Luminaire, in Lighting Dimensions Feb. 2001, pp. 2 and 13.

* cited by examiner

*Primary Examiner*—Don Wong
*Assistant Examiner*—Thuy Vihn Tran
(74) *Attorney, Agent, or Firm*—Dorsey & Whitney LLP

(57) ABSTRACT

A multiparameter light is a type of theater light that includes an arc lamp and a shutter in combination with one or more optical components for creating various lighting effects, suitable electrical and mechanical actuating components, and suitable power supplies. The arc lamp power supply has a variable power output for generating flashes from the arc lamp and for maintaining the arc lamp in an operation condition during dark intervals between the flashes. Flashes may be generated in a series to realize a stroboscopic effect or a lightning effect. The shutter may be used collaboratively with the flashing of the arc lamp to optimize flash characteristics and increase effect options beyond those obtainable from flash or shutter individually. The generation of flashes and operation of the shutter are controlled by a control system in the multiparameter light.

102 Claims, 9 Drawing Sheets

METHOD AND APPARATUS FOR GENERATING A FLASH OR SERIES OF FLASHES FROM A MULTIPARAMETER LIGHT

CROSS-REFERENCE TO RELATED APPLICATIONS

This application claims the benefit of U.S. Provisional Application No. 60/280,613, filed Mar. 29, 2001; U.S. Provisional Application No. 60/248,998, filed Nov. 14, 2000; and U.S. Provisional Application No. 60/204,250, filed May 15, 2000; all of which are hereby incorporated herein by reference in their entirety.

BACKGROUND OF THE INVENTION

1. Field of the Invention

The present invention relates to theatre lighting, and more particularly to a method and apparatus for generating a flash or series of flashes from a multiparameter light.

2. Description of Related Art

Theatre lighting devices are useful for many dramatic and entertainment purposes such as, for example, Broadway shows, television programs, rock concerts, restaurants, nightclubs, theme parks, the architectural lighting of restaurants and buildings, and other events. A multiparameter light is a theatre lighting device that includes a light source and one or more effects known as "parameters" that are controllable typically from a remotely located console, which is also referred to as a central controller or central control system. For example, U.S. Pat. No. 4,392,187 issued Jul. 5, 1983 to Bornhorst and entitled "Computer controlled lighting system having automatically variable position, color, intensity and beam divergence" describes multiparameter lights and a console. Multiparameter lights typically offer several variable parameters such as strobe, pan, tilt, color, pattern, iris and focus. See, for example, the High End Systems Product Line 2000 Catalog, which is available from High End Systems Inc. of Austin, Tex. The variable parameters typically are varied by optical and mechanical systems driven by microprocessor-controlled motors located inside the housing of the multiparameter light.

A stroboscopic effect is a number of high-intensity short-duration light pulses, which are commonly known as flashes. In conventional multiparameter lights, the strobe parameter is a stroboscopic effect realized with set of algorithms optimized to create a standard best quality stroboscopic effect using the mechanical shutter. The algorithms are stored in a memory of the multiparameter light and are evoked by control values from the remote console over a strobe or shutter control channel. However, other stroboscopic effects may be realized with different algorithms that do not necessarily create the standard stroboscopic effect. For instance, a random strobe with varying dark periods is another type of stroboscopic effect available over the strobe control channel. Other stroboscopic effects may also be available to be controlled over the strobe control channel, such as, for example, slow ramp up and fast ramp down strobes. These different stroboscopic effects typically are all controllable from the strobe control channel and make available more variants for the programmer of the lights.

Multiparameter lights typically use high intensity light sources such as metal halide lamps. A metal halide lamp typically requires a high voltage ignition system to "strike" the lamp into operation. The high voltage ignition system provides the high voltage required by the lamp to carry an electric current between the electrodes. Once current flow is established between the electrodes of the lamp, an operating supply voltage that is typically much lower than the striking voltage is employed to continuously operate the lamp.

If a lamp is shut off, the procedure of applying the striking voltage to the lamp to re-ignite the lamp must be repeated. If one desires to re-ignite a lamp that is warm from operating, the striking voltage needed is higher than the striking voltage needed to re-ignite a cold lamp. This is because as the lamp heats up during operation, the impedance between the electrodes rises. As the lamp cools down, the required striking voltage is reduced.

Because metal halide lamps require high voltage ignition systems and the voltage requirement for the ignition increased with lamp temperature, they cannot be switched off and on rapidly and continuously without considerable expense. Hence, multiparameter lights typically implement the stroboscope parameter by using mechanical shutters.

A mechanical shutter works by controllably blocking and unblocking the light beam from the lamp within the multiparameter light. The mechanical shutter may be formed of a metal such as aluminum, mirrored glass, or steel, and may be driven by a motor or an actuator such as a solenoid. When the mechanical shutter is placed by the motor to block the light beam, very little light exits the multiparameter light. When the mechanical shutter is placed to avoid blocking the light beam, i.e. when it is open, the path of the light through the shutter is clear and the full intensity of the light beam exits the multiparameter light.

More recently, alternatives to mechanical shutters have become available. Generally, a shutter may be any suitable means to block and not block (i.e. open) the light from the light beam created by the lamp, including electronic shutters that become more reflective and less reflective such as some LCDs and that redirect light such as DMDs and some LCDs.

While mechanical shutters are effective for a variety of stroboscopic effects, their usefulness is limited because the strobe contrast declines with an increasing strobe rate. Mechanical shutters are most often driven by motors that are controlled by a microprocessor-based control system located in the multiparameter light housing. The speed of the mechanical shutters is limited by the weight of the shutter itself and the capability of the motor driving the shutter. Mechanical shutters operate reasonably well and provide reasonable strobe contrast at low to moderate strobe rates such as, for example, one flash per second. However, the strobe contrast is reduced at higher strobe rates such as, for example, about ten flashes per second. Reduction in the strobe contrast occurs when the shutter cannot move fast enough to effectively block and unblock the light beam. At ten flashes per second, a mechanical shutter typically provides a poor contrast between the light duration and the dark duration. At greater shutter speeds, the contrast suffers so greatly that the stroboscopic effect produced by the multiparameter light is ineffective.

Illustrative shutter systems in common use are shown in FIGS. 1–7. FIGS. 1–4 illustrate the mechanical action of one kind of shutter system commonly used for the stroboscope in the multiparameter light. Shown is a motor 2, a motor shaft 4, a wedge shaped shutter 6, and a light beam 9 as illustrated by a circular dotted line. Also shown is an aperture 8 through the shutter 6, for passing the light from the light beam unobstructed. In FIG. 1, the shutter 6 is in a light sustaining position, having placed the aperture 8 in coincidence with the light beam 9 as it moves at maximum velocity from top to bottom as shown by the long curved arrow. Next as shown in FIG. 2, the shutter 6 is in one darkness sustaining position, having moved the aperture 8 away from the light beam 9 while in the process of reversing direction. Next as shown in FIG. 3, the shutter 6 is in a light sustaining position, having placed the aperture 8 in coincidence with the light beam 9 as it moves at maximum velocity from bottom to top as shown by the long curved arrow. Next as shown in FIG. 4, the shutter 6 is in another darkness sustaining position, having moved the aperture 8 away from the light beam 9 while in the process of reversing direction. Next, the shutter 6 returns to a light sustaining position identical to the position shown in FIG. 1. FIG. 6 illustrates another type of shutter system. Shown is a motor 12, a motor shaft 14, a shutter 16, and a light beam 19 as illustrated by the dotted circle. A large curve arrow indicates the direction of movement of the shutter 16. FIG. 7 illustrates another type of shutter system using two motors 22 and 32 and respective shutters 26 and 36 which are attached to motor shafts 24 and 34. Large curved arrows indicate the direction of movement of the shutters 26 and 36 relative to a light beam 29, which is illustrated by a dotted circle.

Electronic stroboscopic effects have been achieved using Xenon lamps in high power lighting devices other than multiparameter lights; see, e.g., Easy™ model 2000/2500/3000 outdoor xenon searchlight, which is available from Space Cannon Illumination Inc. of Edmonton, Alberta, Canada. However, xenon lamps are much easier to cause to strobe than the metal halide lamps commonly found in multiparameter lights.

Generally, Xenon lamps do not require a warm up time after they are ignited by a high voltage ignition current. Repeated striking or energizing of a Xenon lamp to produce a stroboscope is quite possible as Xenon lamps do not require a warm up time and instantaneously produce high contrast ratios when used to create a stroboscope. Compact metal halide lamps like those commonly used with multiparameter lighting devices and mercury vapor lamps require warm up times where the metal contained within the arc tube is vaporized.

Multiparameter lights are controlled by a remote console operating in conjunction with a communications system. Most often the communications system protocol used is the DMX standard developed by the United States Institute of Theatre Technology ("USITT"). Basically, the DMX512 protocol requires a continuous stream of data at 250 Kbaud which is communicated one-way from the remote console to the theatre devices. Typically, the theater devices use an Electronics Industry Association ("EIA") standard for multipoint communications know as RS-485. The DMX 512 standard supports up to 512 channels of control. Multiparameter lights having parameters such as pan, tilt, strobe, dimming, color change, focus, zoom, pattern, and iris may often require up to 20 separate channels of control. Typically multiparameter lighting systems may employ over 20 multiparameter lights. In a multiparameter lighting system using the DMX 512 standard with each light requiring up to 20 channels of control, all of the 512 channels available may easily be used. This means that it is an advantage to maintain the number of channels required to operate the multiparameter light at a minimum.

Accordingly, a need exists for multiparameter lights that can achieve good strobe contrast at fast strobe rates. A need also exists for improving strobe contrast even at low to moderate strobe rates. A need also exists for operating multiparameter lights having enhanced strobe capabilities without increasing the number of channels required for control thereof.

SUMMARY OF THE INVENTION

It is an object of at least some of the embodiments of the invention to provide an improved stroboscope for a multiparameter light, the improved stroboscope having both a mechanical strobe and an electronic strobe as well as coordinated operation thereof to achieve improved and additional stroboscopic effects.

It is an object of at least some of the embodiments of the invention to provide for control of an improved stroboscope having mechanical and electronic strobes over a single control channel.

It is an object of at least some of the embodiments of the invention to provide for coordinated operation of mechanical and electronic strobes in a multiparameter light.

It is an object of at least some of the embodiments of the invention to maintain the average operating power level of the lamp of a multiparameter light at no more than about the maximum rated power level of the lamp for any particular strobe rate, even while operating the lamp during one or more flashes at greater than the maximum rated power level.

It is an object of at least some of the embodiments of the invention to maintain the average operating power level of the lamp of a multiparameter light at no less than about the minimum rated power level of the lamp for any particular strobe rate, even while operating the lamp between flashes at less than the minimum rated power level.

Some or all of these and other objects and advantages are realized in the various embodiments of the invention. One such embodiment is a method of operating a multiparameter light having a control system, a shutter and an arc lamp to obtain a stroboscopic effect. The method comprises operating the shutter over a first plurality of cycles to obtain flashes at a first frequency, under control of the control system in response to a command signal; and applying a first operating power and a second operating power alternately to the arc lamp over a second plurality of cycles to obtain flashes at a second frequency, under control of the control system in response to a command signal.

Another such embodiment is a method of operating a multiparameter light to obtain a stroboscopic effect, the multiparameter light having a shutter and a mercury-filled lamp powered by a variable power supply, and the mercury-filled lamp having a maximum rated power level and a minimum rated power level. The method comprises determining a high operating power for the mercury-filled lamp; determining a low operating power for the mercury-filled lamp; determining a first duration over which to apply the high operating power to the mercury-filled lamp; determining a second duration over which to apply low high operating power to the mercury-filled lamp; and alternately applying the high operating power for the first duration and the low operating power for the second duration to the mercury-filled lamp over a plurality of cycles to obtain flashes having a desired frequency and duration, wherein the shutter is open for at least a portion of each of the flashes. The high operating power determining step, the low operating power determining step, the first duration determining step, and the second duration determining step result in an average power during the applying step of between about the maximum rated power level and about the minimum rated power level of the mercury-filled lamp.

Another such embodiment is a multiparameter light comprising an arc lamp; a variable power supply coupled to the arc lamp; a shutter; and a control system having an output coupled to the shutter for operating the shutter to obtain a stroboscopic effect, and an output coupled to the variable power supply for operating the arc lamp to obtain a stroboscopic effect.

Yet another such embodiment is a multiparameter light comprising a shutter; an arc lamp; a variable power supply coupled to the arc lamp; and a control system having an output coupled to the variable power supply for operating the arc lamp to obtain a series of flashes, and an output coupled to the shutter for opening the shutter for at least a portion of each of the flashes.

A further such embodiment is a method of operating a multiparameter light, the multiparameter light including at least an arc lamp having a maximum rated power level, a shutter, and a control system. The method comprises applying operating power to the arc lamp less than the maximum rated power level; generating with the control system in response to a command signal a plurality of lamp power control signals; and after the step of applying operating power to the arc lamp less than the maximum rated power level and in response to the lamp power control signals, applying operating power to the arc lamp greater than the maximum rated power level over a first duration and less than the maximum rated power level over a second duration to generate a flash.

Another such embodiment is a method of operating a multiparameter light having at least a shutter and an arc lamp having a maximum rated power level. The method comprises applying operating power to the arc lamp less than the maximum rated power level; after the step of applying operating power to the arc lamp less than the maximum rated power level, applying operating power to the arc lamp greater than the maximum rated power level over a first duration and less than the maximum rated power level over a second duration to generate a flash; and operating the shutter in coordination with the step of applying operating power to generate the flash.

A further such embodiment is a method of operating a multiparameter light, the multiparameter light having a shutter and a mercury-filled lamp powered by a variable power supply, and the mercury-filled lamp having a maximum rated power level and a minimum rated power level. The method comprises determining a high operating power for the mercury-filled lamp greater than the maximum rated power level; determining a low operating power for the mercury-filled lamp less than the minimum rated power; applying various operating powers, including the high operating power and the low operating power, over various time intervals to the mercury-filled lamp to obtain a plurality of flashes; and determining an average power of the various operating powers applied over the various time intervals to the mercury-filled lamp in the applying step; wherein the high operating power determining step and the low operating power determining step are based on maintaining the average power not greater than about the maximum rated power level, and on maintaining the average power not less than about the minimum rated power level.

Yet another such embodiment is a multiparameter light comprising a shutter; a mercury-filled lamp; a variable power supply coupled to the mercury-filled lamp; and a control system having an output coupled to the variable power supply for operating the mercury-filled lamp at various power levels over various durations to obtain flashes of varying duration and intensity and to obtain dark intervals of varying duration and intensity between the flashes, and an output coupled to the shutter for opening the shutter for at least a portion of each of the flashes.

DETAILED DESCRIPTION OF THE PREFERRED EMBODIMENT

A multiparameter light is a type of theater light that includes a light source such as a lamp in combination with one or more optical components such as reflectors (the lamp and reflector may be integrated if desired), lenses, filters, iris diaphragms, shutters, and so forth for creating special lighting effects, various electrical and mechanical components such as motors and other types of actuators, wheels, gears, belts, lever arms, and so forth for operating some of the optical components, suitable electronics for controlling the parameters of the multiparameter light, and suitable power supplies for the lamp, motors, and electronics. The multiparameter light also includes a stroboscope, which preferably is implemented by using mechanical and electronic strobe systems to increase performance options and by using the mechanical and electronic strobe systems collaboratively to optimize the performance of the stroboscope in ways that otherwise could not be obtained using either system individually. Stroboscopic effects are created by a mechanical strobe operating alone, an electronic strobe operating alone, or by the mechanical strobe and the electronic strobe operating together. The mechanical and electronic strobe systems preferably are operated through a single control channel that provides the operator controlling the light the greatest ease of operation.

The waveforms that are shown in FIGS. 11–16 show one type of stroboscopic effect, namely a series of flashes of substantially constant duration. As shown, each of the waveforms has several cycles, with each cycle having a light sustaining period, which is the pulse, and a dark sustaining period, which is the interval between pulses. The light sustaining period preferably is chosen from about one millisecond to about one hundred milliseconds, and the dark sustaining period preferably is varied to change the flash frequency. However, the flash frequency may also be changed by varying only the light sustaining period, or by varying both the light and dark sustaining periods. The sharpest contrast for the stroboscopic effect is achieved by creating light pulses with fast rise and fall times.

Figure 8:
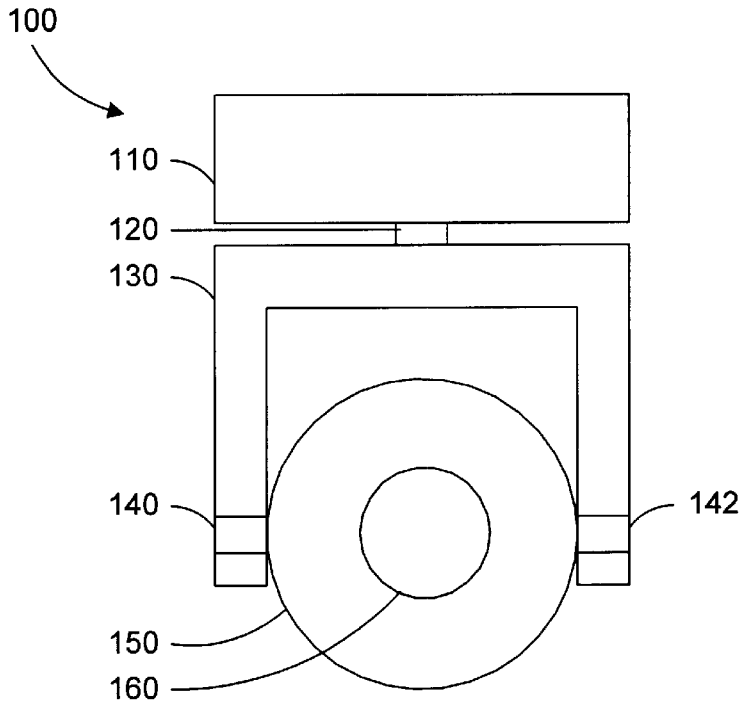
FIG. 8 is an external schematic diagram of a multiparameter light having two housing sections.
Figure 9:
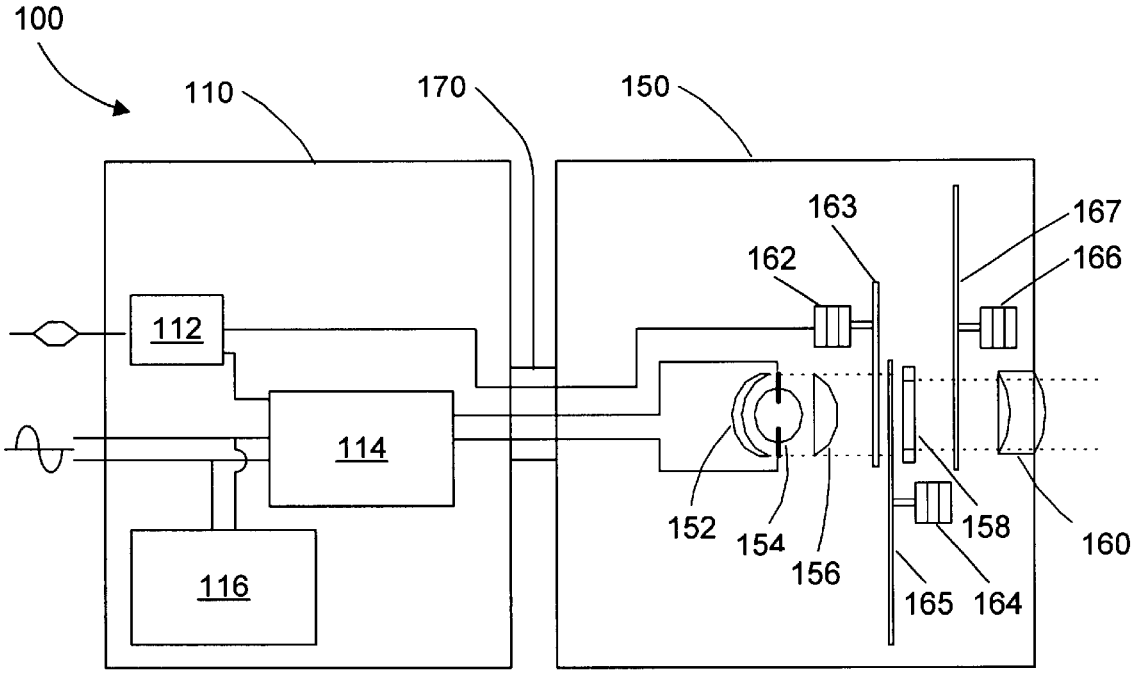
FIG. 9 is an internal schematic diagram of the multiparameter light of FIG. 8, which includes a mechanical shutter and an arc lamp powered by a variable power supply.

FIG. 8 and FIG. 9 are views of a multiparameter light 100 that has separate base and lamp sections with respective housings 110 and 150, which on pan and tilt lights are mechanically attached by a yoke 130 and bearings 120, 140 and 142 to allow the lamp housing 150 to be variably positioned with respect to the base housing 110. While multiple bearing assemblies typically are used, a simplified bearing assembly—bearing 120 for pan, 20 bearings 140 and 142 for tilt—is shown in the figure for clarity. The base housing 110 of FIG. 9 contains an on-board control system or control circuit 112 which includes an external communications interface, one or more programmable microcontroller(s) or microprocessor(s) (the terms are used interchangeably), a suitable amount of memory for the microprocessor, and any necessary control interface circuits. Alternatively, the on-board control system 112 may include hardwired logic instead of programmable logic such as the microcontroller. The on-board control system 112 may be contained on a single logic card or on several logic cards, as desired. The base housing also contains a variable lamp power supply 114 and the motor and electronics power supply 116 (power wiring from the power supply 116 to the various electronic circuits and motors is omitted for clarity). The lamp housing 150 contains a reflector 152, an arc lamp 154, a condensing lens 156, an iris diaphragm 158, and a focussing lens 160. The light beam through and exiting the multiparameter light 100 is shown by the dotted lines. The lamp housing 150 also contains a shutter 163 and shutter motor 162, two filter wheels 164 and 166, and respective filter wheel motors 165 and 167. Various wires are run between the base housing 110 and the lamp housing 150 (many wires are omitted for clarity) through a wireway 170, which typically is a flexible conduit or pathway through the bearings 120, the yoke 130, and the bearings 140.

Figure 10:
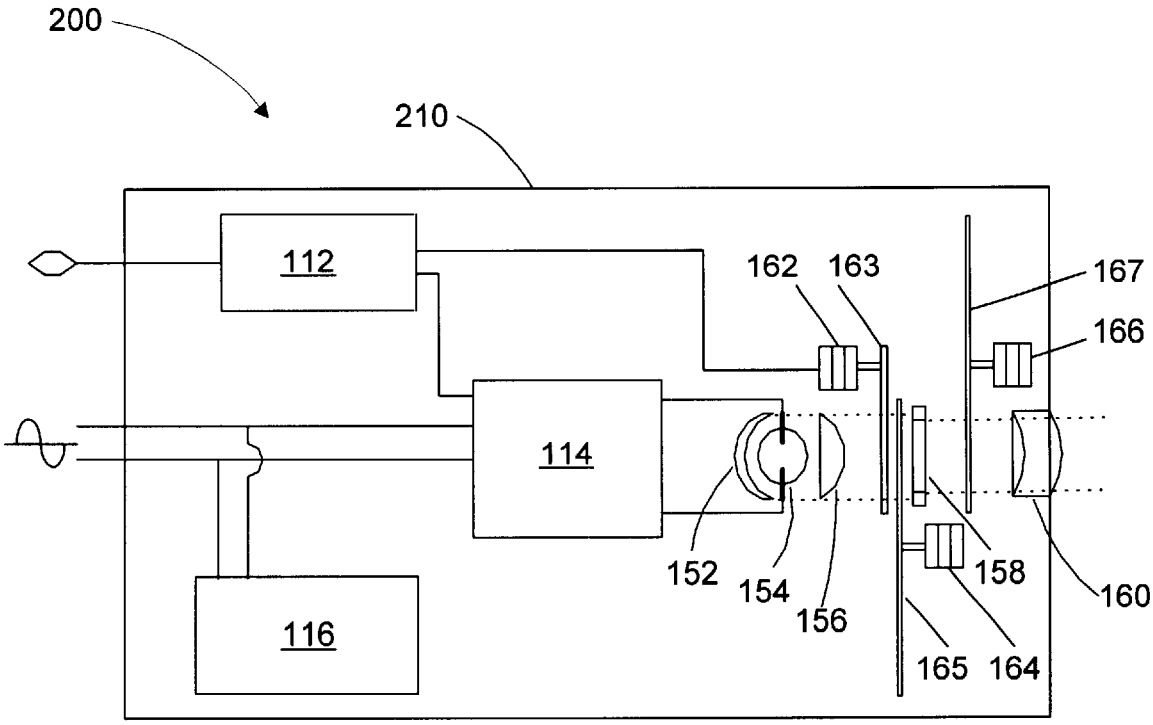
FIG. 10 is an internal schematic diagram of a multiparameter light having a single housing and which includes a mechanical shutter and an arc lamp powered by a variable power supply.

A multiparameter light also may be contained in a single housing as shown in FIG. 10. The multiparameter light 200 has a lamp housing 210 which contains many of the same type of components as the multiparameter light of FIG. 9 (the component values may of course be different). The multiparameter light 200 may if desired include a positionable reflector (not shown) to enable pan and tilt parameters.

The lamp 154 may be any suitable type of arc lamp, including arc lamps of the metal halide, mercury, or xenon type. For example, a suitable metal halide lamp is model MSR1200, which is available from the Philips Lighting Company of Somerset, N.J. A variety of mercury lamps are available from Advanced Radiation Corporation of Santa Clara, Calif.

Generally speaking, an arc lamp is constructed of a bulb of clear optical material such as quartz and two electrodes that insert through the bulb. Inside the bulb, an electrical arc is formed between the electrodes and produces an intense light. The color of the light is influenced by the filling of the lamp, which typically is xenon, mercury vapor, or a mixture of the two. Other type of gases, for example neon or argon, may also be used to fill the bulb. A mercury lamp is constructed of a mercury fill. A metal halide lamp is essentially a modified mercury lamp in that it is constructed of a mercury fill along with metal halides such as sodium iodide and scandium iodide. The metal halides are used to produce a better color of visible light than that of pure mercury lamps, and to increase efficiency. Mercury lamps constructed without halides may be constructed with a high fill pressure of mercury vapor to improve spectral performance.

Different types of arc lamps require different types of power supplies which may operate quite differently. For instance, Xenon arc lamps typically require a very high ignition voltage, yet do not require a substantial warm uptime. Mercury and metal halide arc lamps require a lower ignition voltage than Xenon arc lamps, but have a significant warm up time.

The variable lamp power supply operates by varying the power (i.e. varying voltage, current, or both voltage and current) to the lamp 154, and may be implemented in various ways such as by using a transformer or solid state devices. Some solid state power supplies utilize a type of semiconductor output device known as an Insulated Gate Bipolar Transistor, or IGBT, which can be used to provide an adjustable current to the lamp as is well known in the art. A variable power supply may also be obtained by passing the output of a fixed power supply through a variable inductance, through a voltage converter, or any other type of circuit capable of controllably varying a voltage, current or power to a lamp.

The control system 112 provides many functions. The external communications interface in the control system 112 receives communication and command signals from a remote console (not shown) to vary the parameters of the multiparameter light. The microprocessor in the control system 112 operates the electromechanical system of motors for the various parameters and for the cooling system (not shown), if any is present, and also controls the lamp power supply 114. For example, both the shutter motor 162 and the lamp power supply 114 are shown connected to the control system 112 by respective wires so that their operations may be controlled by the microprocessor in the control system 112. Alternatively, the shutter motor 162 and the lamp power supply 114 may be addressable and connected to the control system 112 by a bus.

The stroboscope parameter is implemented preferably by coordinating the action of the shutter 163 and the lamp 154 under control of the control system 112. While the action of the shutter 163 and the lamp 154 may be controlled to achieve a variety of stroboscopic results, some of the possible results are shown in FIGS. 11–16. FIGS. 11–16 are graphical representations of simplified theoretical luminosity waveforms for purposes of explanation.

Figure 1:
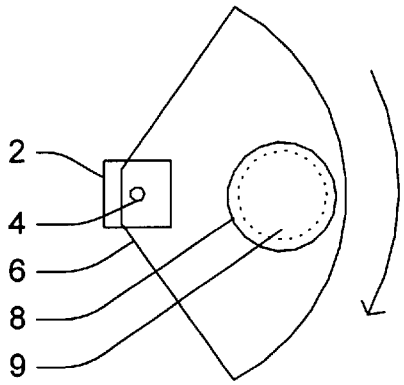
FIG 1 (PRIOR ART)
FIGS. 1–5 are schematic diagrams of one type of prior art shutter system in various positions relative to a beam of light.
Figure 2:
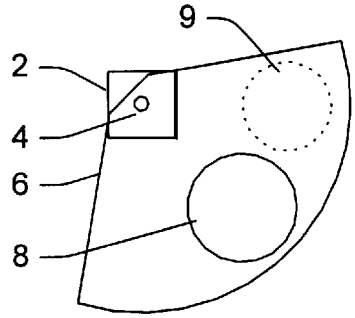
FIG 2 (PRIOR ART)
Figure 3:
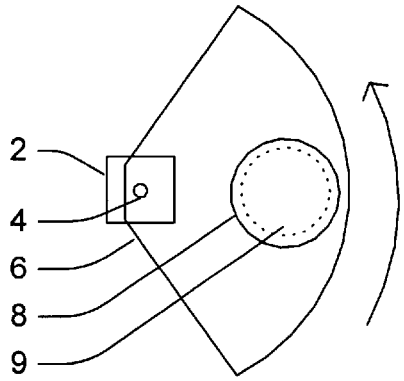
FIG 3 (PRIOR ART)
Figure 4:
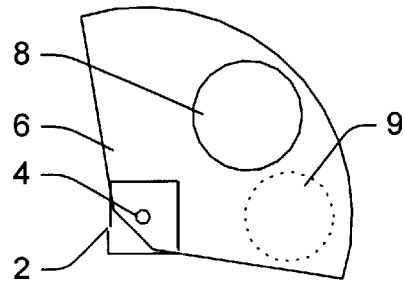
FIG 4 (PRIOR ART)
Figure 5:
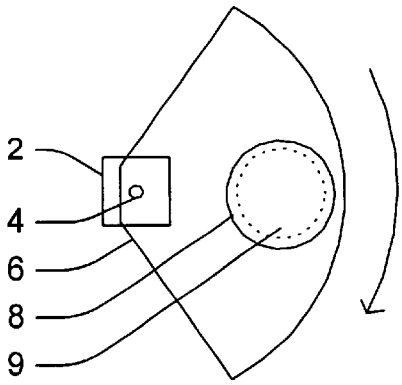
FIG 5 (PRIOR ART)
Figure 6:
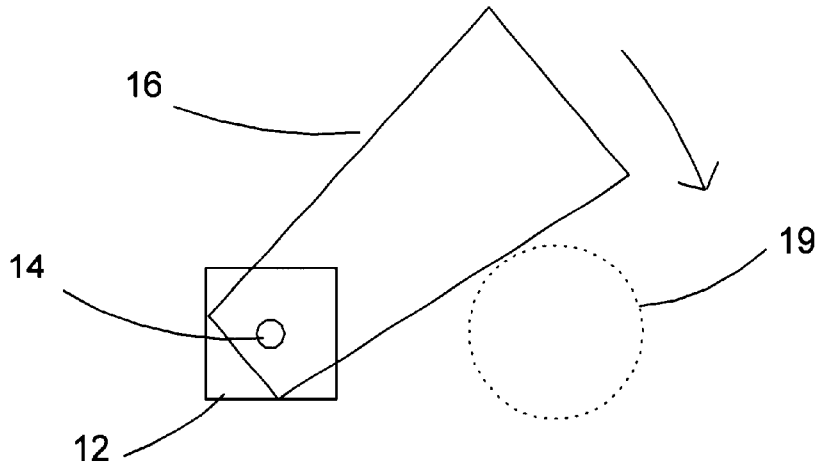
FIG 6 (PRIOR ART)
FIG. 6 is a schematic diagram of another type of prior art shutter system relative to a beam of light.
Figure 7:
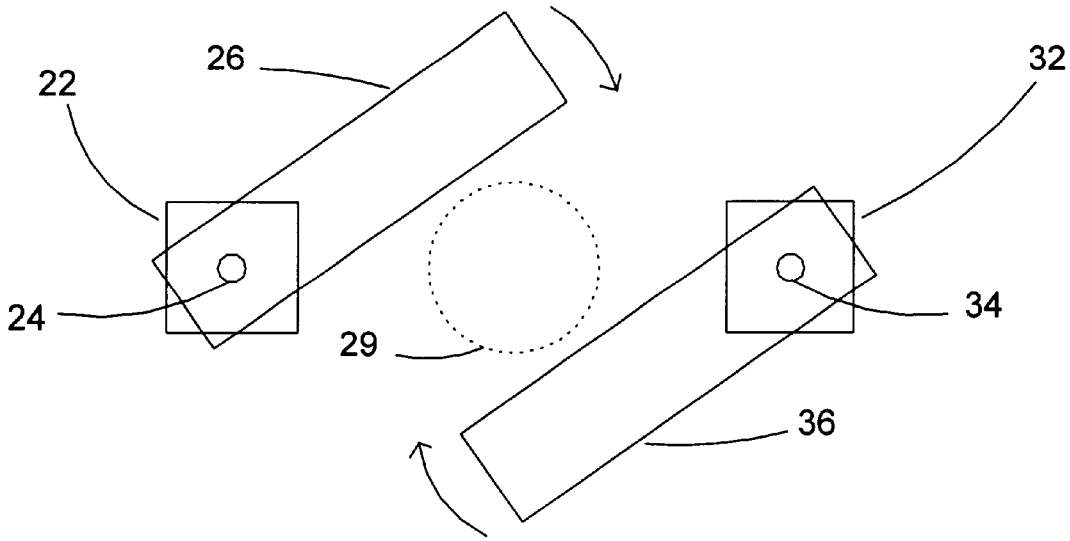
FIG 7 (PRIOR ART)
FIG. 7 is a schematic diagram of another type of prior art shutter system relative to a beam of light.
Figure 11:
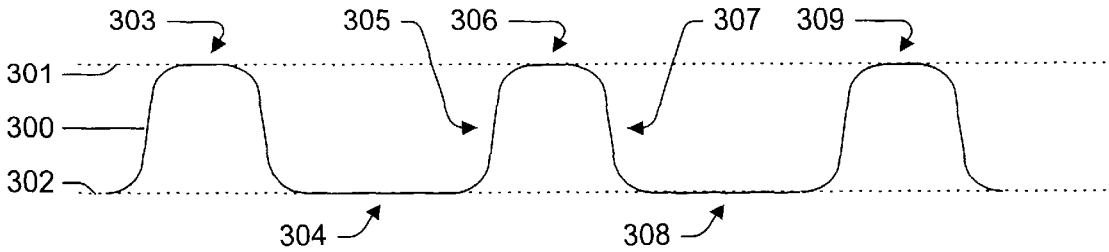
FIGS. 11–16 are simplified theoretical luminosity waveforms useful for explaining various stroboscopic effects.

FIG. 11 shows a waveform 300 that represents the intensity of a light beam relative to time from a multiparameter light having a mechanical shutter system such as shown in FIGS. 1–5. The mechanical shutter system is operating at a relatively low strobe rate, illustratively about three flashes per second. A horizontal dotted line 301 indicates the maximum amount of light available from the light beam that can be passed through the shutter system. A horizontal dotted line 302 indicates that the light beam is completely blocked by the shutter. Three stroboscopic flashes 303, 306 and 309 occur during the fixed interval shown in the figure. The flashes 303, 306 and 309 correspond to the time when the shutter is in a light sustaining position; for example, as shown in FIGS. 1, 3 and 5 when the aperture 8 is positioned at the light beam, thereby allowing the light beam to pass through the shutter 6 relatively unobstructed. The flashes 303, 306 and 309 are separated by dark intervals 304 and 308. The dark intervals 304 and 308 correspond to the time when the shutter is in a darkness sustaining position; for example, as shown in FIGS. 2 and 4 when the aperture 8 is away from the light beam and the shutter 6 is decelerating in one direction, stationary, and accelerating in the other direction. The flashes 303, 306 and 309 have slow rise and fall times (see, for example, rising edge 305 and falling edge 307 of the flash 306) due to the slow mechanical action of the aperture 8.

Figure 12:
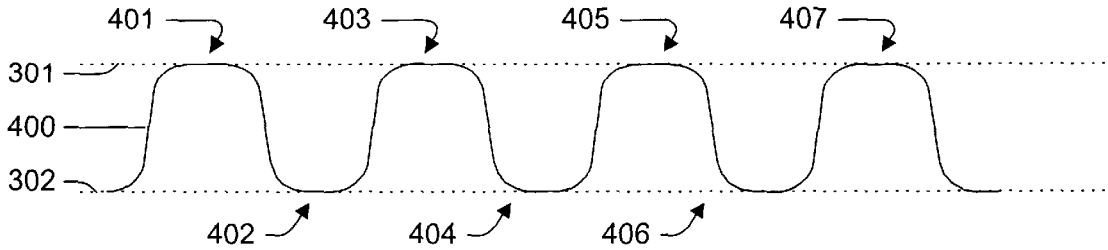

FIG. 12 shows a waveform 400 that represents the intensity of a light beam relative to time from a multiparameter light having a mechanical shutter system such as shown in FIGS. 1–5. The mechanical shutter system is operating at a moderate strobe rate, illustratively about four and a half flashes per second. The horizontal dotted line 301 indicates the maximum amount of light available from the light beam that can be passed through the shutter system, and the horizontal dotted line 302 indicates that the light beam is completely blocked by the shutter. The time interval shown in FIG. 12 is about the same as the time interval shown in FIG. 11. Four stroboscopic flashes 401, 403, 405 and 407 occur during the fixed interval shown in the figure, and have a duration about the same as the duration of flashes 303, 306 and 309 in FIG. 11. The flashes 401, 403, 405 and 407 are separated by dark intervals 402, 404 and 406, which have a duration shorter than the duration of dark intervals 304 and 308 in FIG. 11. The waveform 400 is generated by opening the shutter 6 for about the same amount of time as used to generate the waveform 300, but reversing the direction of the shutter 6 more quickly so that the darkness sustaining position of the shutter 6 is maintained for a shorter period of time. The flashes 401, 403, 405 and 407 have the same mechanically limited slow rise and fall times as the flashes 303, 306 and 309.

It will be appreciated that the rate of flashes may be increased in other ways. For example, one way known in the art is to operate the shutter 6 at a higher velocity, although this technique will result in some differences in the respective durations of the flashes and dark intervals and the rise and fall times of the flashes. The flash duration (light passing time) may be reduced. The shutter may be set so as not to fully allow all light to pass in the open position and not to fully block all light in the closed position. The contrast between light and dark may also be reduced to gain more speed, as illustrated in FIG. 13.

Figure 13:
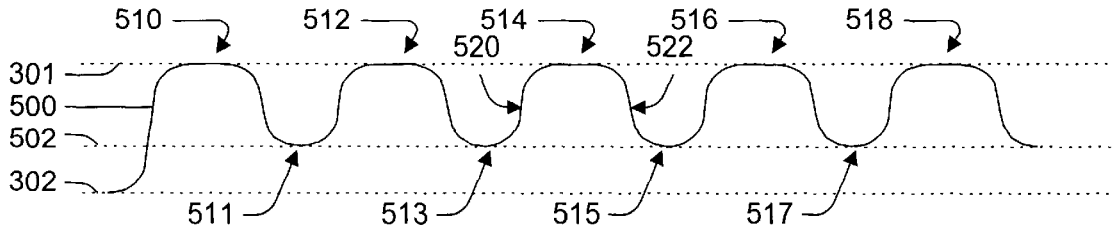

FIG. 13 shows a waveform 500 that represents the intensity of a light beam relative to time from a multiparameter light having a mechanical shutter system such as shown in FIGS. 1–5. The mechanical shutter system is operating at a fast strobe rate, illustratively about five flashes per second. The horizontal dotted line 301 indicates the maximum amount of light available from the light beam that can be passed through the shutter system, and the horizontal dotted line 302 indicates that the light beam is completely blocked by the shutter. A third horizontal line, line 502, indicates the lowest level of intensity that can be achieved by the mechanical shutter system before the shutter must turn around so that it can accomplish the required number of flashes in the prescribed interval. The time interval shown in FIG. 13 is about the same as the time interval shown in FIG. 11. Five stroboscopic flashes 510, 512, 514, 516 and 518 occur during the fixed interval shown in the figure, and have a duration about the same as the duration of flashes 303, 306 and 309 in FIG. 11 and flashes 401, 403, 405 and 407 in FIG. 12. The flashes 510, 512, 514, 516 and 518 are separated by dark intervals 511, 513, 515 and 517, which have a duration shorter than the duration of dark intervals 402, 404 and 406 in FIG. 12. The waveform 500 is generated by opening the shutter 6 for about the same amount of time as used to generate the waveforms 300 and 400, but reversing the direction of the shutter 6 more quickly. In fact, the direction is reversed so quickly that the darkness sustaining position of the shutter 6 is never completely attained so that some of the light beam passes through the aperture 8 even during the dark intervals 511, 513, 515 and 517.

The strobe contrast of waveform 500 is worse than the strobe contrasts of waveforms 300 and 400. The poor strobe contrast is primarily attributable to two factors. First, the light beam is never fully blocked by the shutter because of the limitations of the mechanical shutter systems, so that some light intensity is present even during the dark intervals 511, 513, 515 and 517. Second, the rise and fall times of the flashes 510, 512, 514, 516 and 518 is so slow relative to the flash repetition rate that a significant amount of the dark intervals 511, 513, 515 and 517 includes light of a higher intensity that the low intensity level shown by line 302.

The poor strobe contrast exhibited by mechanical shutter systems at high flash repetition rates is improved in the multiparameter lights of FIGS. 9 and 10, for example, by rapidly cycling the power to the arc lamp 154 from a high operating power to a low operating power and back again, instead of using the mechanical shutter 163. An arc lamp typically is specified by the lamp manufacturer or by the manufacturer of the multiparameter light which contains the lamp for (a) continuous operation at a maximum rated power level over a specified lifetime; and (b) continuous operation at a minimum rated power level for dimming purposes or reduced output. Some manufactures may operate the lamp at the maximum rated power level discontinuously (turning the lamp on and off) to determine the specified lifetime. Some manufactures may not specify a minimum rated power level, in which case the minimum rated power level for such lamps is the power level that keeps the lamp from extinguishing or blackening during continuous use. For compact metal halide lamps, for example, a minimum rated power level of 40% of the maximum rated power level is often specified. This means that a variable lamp power supply may be used to rapidly and alternately operate the lamp electronically between 100% of the maximum rated power level and 40% of the maximum rated power level without having to re-ignite the lamp. The reduced lamp power level is specified by the manufacturer of the lamp or of the multiparameter light containing the lamp so that the temperature of the plasma within the lamp remains hot enough to prevent the arc from becoming extinguished. The lamp also should be run hot enough so that the glass envelope surrounding the lamp does not prematurely blacken.

Figure 14:
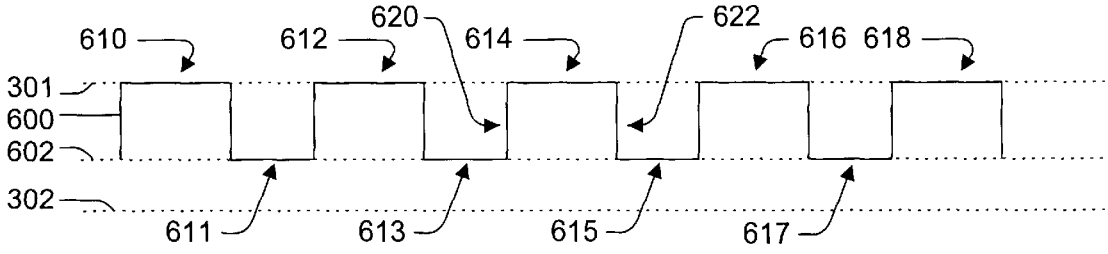

FIG. 14 shows a waveform 600 that represents the results achievable with this technique. The time interval shown in FIG. 14 is about the same as the time interval shown in FIGS. 11–13, and the flash repetition rate of the waveform 600—hence the number of flashes during the interval—is the same as for waveform 500 of FIG. 13. As in the earlier figures, the horizontal dotted line 301 indicates the maximum amount of light available from the light beam that can be passed through the shutter system, and the horizontal dotted line 302 indicates that the light beam is completely blocked by the shutter. A third horizontal line, line 602, indicates the lowest level of intensity that results when the arc lamp 154 is operated at its minimum operating level, which is the lowest level of intensity of the lamp as controlled by the power supply, e.g. the lamp variable power supply 114, that can be reliably achieved without the lamp plasma going too cold or becoming extinguished. Five stroboscopic flashes 610, 612, 614, 616 and 618 occur during the fixed interval shown in the figure, and have a duration about the same as the duration of flashes 510, 512, 514, 516 and 518 in FIG. 13. The flashes 610, 612, 614, 616 and 618 are separated by dark intervals 611, 613, 615 and 617.

The strobe contrast of waveform 600 is superior to that of waveform 500. Even though the presence of some light intensity during the dark intervals 611, 613, 615 and 617 of waveform 600, as indicated by the line 602, is similar to the presence of some light intensity in the center of the dark intervals 511, 513, 515 and 517 of waveform 500, as indicated by the line 502, the rise and fall times of the flashes 610, 612, 614, 616 and 618, see, e.g., leading edge 620 and trailing edge 622, is quite a bit faster than the rise and fall times of pulses achieved with a mechanical shutter system, see, e.g., leading edge 520 and trailing edge 522 (FIG. 13), resulting in a sharper contrast. In addition, generally less light is present during the dark intervals 611, 613, 615 and 617 of waveform 600 than during the dark intervals 511, 513, 515 and 517 of waveform 500.

Figure 15:
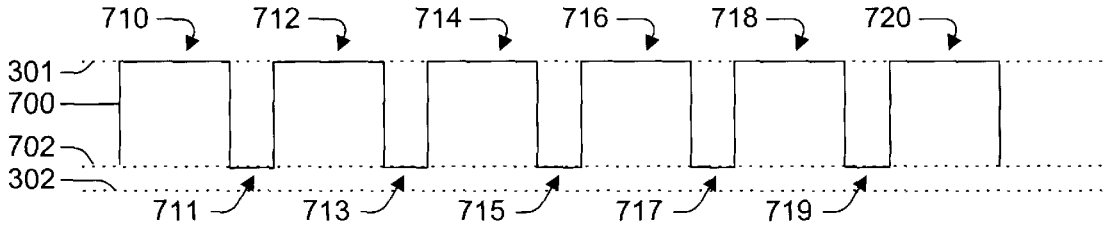

The technique of implementing the stroboscope by rapidly cycling the power to the arc lamp of a multiparameter light is extended to even higher repetition rates with an improved strobe contrast by reducing the lowest level of intensity beyond that which results when the arc lamp 154 is operated at its minimum operating level, as shown by waveform 700 in FIG. 15. This new minimum level, which is indicated by line 702 in FIG. 15, is achieved by calculating the duty cycle of the lamp while operating at the increased flash repetition rate and allowing a new minimum level to be set for the stroboscope that still provides the lamp the ability to operate at close to the same overall or average operating power as shown in waveform 600. The low operating power level indicated by the line 702 is lower than the low operating power level indicated by the line 602 in FIG. 14 because the number of flashes in the interval is increased, thereby allowing the lamp plasma to retain similar heat during the operation producing the waveform 700 as during the operation producing the waveform 600.

The lowest operating power level of an arc lamp that is achievable without the lamp plasma going too cold or extinguishing may be estimated by calculating the overall energy resulting at a particular strobe rate. For example, a manufacturer of the lamp or of the multiparameter light containing the lamp, typically specifies a maximum rated power level and a minimum rated power level. The maximum and minimum rated power levels are based on continuous operation of the lamp, with the minimum rated power level typically being stated as a percentage of the maximum rated power level. Nonetheless, a low operating power level less than the minimum rated power level may be used depending on the strobe rate, especially for fast strobe rates. Essentially, if the average operating power level during strobing is greater than the minimum rated power level, the low operating power level can be reduced to about the point that the average operating power level becomes close to the minimum rated power level. In this way, the plasma in the lamp remains hot enough so that the lamp does not go cold or become extinguished. For some lamps the plasma should also remain hot enough to effectively clean the arc tube so that the envelope that contains the plasma does not blacken.

For example, specifying a metal halide lamp as being able to operate at, say, 40% of the maximum rated power level to avoid the lamp from becoming extinguished or blackened means that the lamp may operate at a continuous low operating power level of 40%. However, if the lamp flashes at the maximum rated power level for a 10 ms pulse ten times every second, it is operating at 40% plus 10% (the ten 10 ms pulse each second) of the difference between 100% and 40%. The difference is 60% so therefore the lamp is operating at 40% plus 1/10 of 60% for a total or 46%. We can see that the low operating power level of the lamp can be thought of as being a continuous 46% of the maximum rated power level. With this in mind, we may think of a 40% continuous operating power level as being equivalent to the lamp operating at a low operating power level of X% plus 10% of the difference between 100% and X%, which represents the lamp flashing at its maximum rated power level for ten 10 ms pulse every second. In this example the low operating power level would be about 33.3%. If the flashing frequency is increased by decreasing the duration of the dark interval, then the low operating power level may be set even lower. In other words, the duty cycle control of the lowest level of the lamp may be found by calculating the effective average lowest level of the lamp and lowering the lowest level of the lamp to produce the same effective minimum recommended level. However, it will be appreciated that other factors may influence the recommend minimum rated power level. For example, the plasma tube (arc tube) of the lamp should remain at a minimum temperature to keep the plasma tube from blackening. Moreover, if the lamp voltage is reduced too low, conductance between the electrodes may not occur. Different lamps provide more or less flexibility in operating at dynamically changing low operating power levels in accordance with the foregoing duty cycle calculation.

FIG. 15 illustrates the improved high repetition rate operation in detail. The time interval shown in FIG. 15 is about the same as the time interval shown in FIGS. 11–14, as is the duration of each flash. As in the earlier figures, the horizontal dotted line 301 indicates the maximum amount of light available from the light beam that can be passed through the shutter system, and the horizontal dotted line 302 indicates that the light beam is completely blocked by the shutter. A third horizontal line, the line 702, indicates the lowest level of intensity that results when the arc lamp 154 is operated below its minimum operating level, as previously described. Six stroboscopic flashes 710, 712, 714, 716, 718 and 720, occur during the fixed interval shown in the figure. The flashes 710, 712, 714, 716, 718 and 720 are separated by narrow dark intervals 711, 713, 715, 717 and 719. It will be appreciated that the dark intervals 711, 713, 715, 717 and 719 are "darker" than the dark intervals 611, 613, 615 and 617 because the minimum intensity 702 is lower than the minimum intensity 602.

Moreover, pulsing may if desired be done with the high power level set above the maximum rated power level, the low power level set below the minimum rated power level, or with both levels so set, or with both levels set to intermediate values. For example, let us consider a lamp that is rated at 100 watts maximum power and 40 watts minimum power. To simplify our example, consider an illustrative flash rate of ten flashes every second, or one flash every 100 ms, and a flash duration of 10 ms. If power is visualized in 10 ms increments, which is the flash duration, and given that one watt is equal to one Joule per second, 100 watts over a 10 ms interval equals 1 Joule of energy and 40 watts over a 10 ms interval equals 0.4 Joules of energy. A full cycle (100 ms) of continuous operation at the maximum rated power level equals 10 Joules, while a full cycle (100 ms) of continuous operation at the minimum rated power level equals 4 Joules.

Now lets say we strobe the lamp. If we set the low operating power level at 40 watts and the high operating power level at 100 watts, the one 10 ms flash interval equals 1 Joule of energy while the other nine intervals equals 3.6 Joules (9×0.4 Joules), for a total over one cycle of 4.6 Joules. The 4.6 Joules for each strobe cycle of 100 ms is well below the 10 Joules for continuous operation for 100 ms at the maximum rated power level, and is above the 4 Joules for continuous operation for 100 ms at the minimum rated power level.

Therefor, we could raise the high operating power level of a flash above the maximum rated power level of the lamp. For example, if we set the low operating power level at 40 watts and the high operating power level at X watts, the one 10 ms flash interval contains 0.01X Joules while the other nine intervals contain 3.6 Joules (9×0.4 Joules), so that 0.01X Joules+3.6 Joules=10 Joules (the energy in a full cycle (100 ms) of continuous operation at the maximum rated power level), or X=640 watts.

Alternatively, we could both raise the high power above the maximum rated power level of the lamp and lower the low power below the minimum rated power level of the lamp, provided that no more than about 10 Joules of energy results, 10 Joules being the amount of energy in continuous operation for 100 ms at the maximum rated power level, and further provided that no less than about 4 Joules of energy results, 4 Joules being the amount of energy in continuous operation for 100 ms at the minimum rated power level. If we set the high operating power level at X watts and the low operating power level at Y watts, the one 10 ms flash interval contains 0.01X Joules while the other nine intervals contain 0.09Y Joules. The approximate limits may be expressed as 0.01X Joules+0.09Y Joules=10 Joules (high limit) and 0.01X Joules+0.09Y Joules=4 Joules (low limit). Hence, X (high)=1000−9Y and X (low)=400−9Y. If the low operating power level is 40 watts, the high operating power level should not exceed 640 watts as in the immediately previous example and should not be less than 40 watts (which would correspond to continuous operation at the minimum rated power level). If the low operating power level is reduced to 33.3 watts, the high operating power level should not exceed 700 watts and should not be less than 100 watts, as in an earlier example.

The values in the foregoing examples are approximate and are theoretical, for purposes of illustration. Actual lamps and multiparameter lights may have characteristics that will limit the actual high power and low operating power levels that may be used during strobing. For example, the high operating power level may be limited by the ability of the power supply to supply transient power to the lamp by the supply, the strength of the lamp enclosure vessel, and so forth. For example, the low operating power level may be limited by other lamp design factors which may cause the lamp to become unstable, to blacken or to extinguish. Experimenting with various lamps and various variable power supplies will give the best results.

Figure 16:
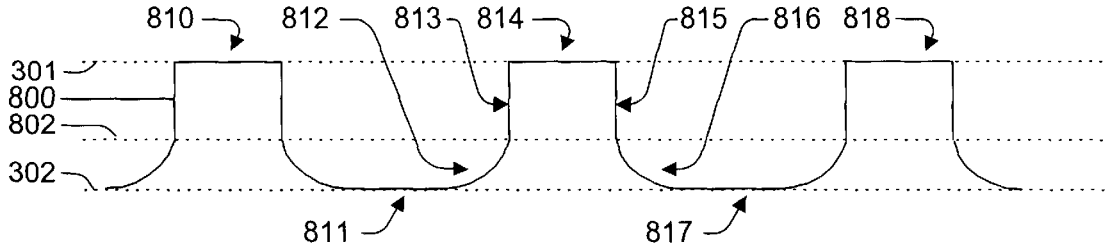

A technique for achieving a superior strobe contrast at low to moderate flash repetition rates involves the use of a mechanical shutter and lamp cycling in combination. Waveform 800 shown in FIG. 16 represents the results achievable with this technique. As in the earlier figures, the horizontal dotted line 301 indicates the maximum amount of light available from the light beam that can be passed through the shutter system, and the horizontal dotted line 302 indicates that the light beam is completely blocked by the shutter. Three stroboscopic flashes 810, 814 and 818 occur during the fixed interval shown in the figure, and are separated by dark intervals 811 and 817.

The waveform 800 shows a sharper strobe contrast over that of the waveform 300 (FIG. 11) as the electronic stroboscope aids the shutter in the mechanical stroboscope so that a faster transition between the light sustaining time and the low operating power level of the lamp is achieved. The transitioning of the lamp between low power and high power operation achieves a rapid transition from light to dark, while the mechanical shutter completes the transition between low intensity and full darkness by blocking the light beam. Horizontal dotted line 802 indicates the lowest level of intensity of the lamp as controlled by the power supply that can be reliably achieved without the lamp plasma going too cold or becoming extinguished.

The technique of using the mechanical shutter and lamp cycling in combination to obtain improved strobe contrast may be better understood with reference to flash 814 in the waveform 800. The preceding dark interval 811 corresponds to the time when the mechanical shutter is in a darkness sustaining position and the lamp is operating at the lowest intensity level. The light beam is completely blocked by the shutter. As the mechanical shutter begins to pass light, as shown by leading edge portion 812, only a low intensity light exits the multiparameter light because the lamp is operating at the low intensity level 802. The flash 814 is made by operating the lamp at high intensity when the shutter is sufficiently open to pass the light beam at about its full intensity, resulting in the rapid rising edge section 813. The flash 814 remains at full intensity as the lamp is operated at high intensity during the light sustaining period, and then abruptly terminates when the lamp is operated at low intensity, as shown by trailing edge portion 815. Complete darkness is attained as the mechanical shutter moves into its full dark sustaining position, as shown by trailing edge portion 816, thereby blocking all light and attaining full darkness during the dark interval 817.

In a typical installation that includes multiparameter lights, control is asserted from a remote console over a communications system. For example, the most common type of communications system for multiparameter lights in use today is a digital communications system employing the DMX512 digital communications system protocol, which was developed by United States Institute of Theatre Technology ("USITT"). A control value in the DMX protocol is only one type of command signal, and other protocols may specify other types of command signals. Improved methods of control have been developed, such as the techniques described in U.S. patent application Ser. No. 09/394,300, filed Sep. 10, 1999 (Richard S. Belliveau, "Method and Apparatus for Digital Communications with Multiparameter Light Fixtures," Attorney Docket No. A1096US), which hereby is incorporated herein in its entirety by reference thereto.

The DMX protocol supports a limited number of control channels, specifically 512. While a multiparameter light having both mechanical and electronic strobes may have different channels assigned to control the respective strobes or even to control different stroboscopic effects, this is undesirable because of the limit in the number of available channels allowed by the DMX protocol. Illustratively, a multiparameter light in a theater system has a particular start address and the various channels occupied by the multiparameter light are based on the start address. For example, if the multiparameter light starts on channel 50 and requires 24 channels to operate its various parameters, it will occupy channels 50 through 73. Because the number of channels is limited, preferably the mechanical strobe and the electronic strobe of a multiparameter light are controlled by the same channel. Preferably, the control values allow for independent operation of the mechanical strobe and the electronic strobe as well as collaboration between the mechanical strobe and the electronic strobe to provide a wider range of visual effects, including not only contrast-optimized stroboscopic effects but also various other stroboscopic effects using electronic and mechanical strobing separately or in combination. Preferably, transitions between the action of the mechanical strobe and the electronic strobe are handled by the multiparameter light without direct user intervention, hence are essentially transparent to the user.

One illustrative technique for controlling both the mechanical strobe and electronic strobe over a single channel is to use suitable logic in the multiparameter light to generate from the DMX value on a single channel appropriate control signals for the mechanical strobe and/or the electronic strobe. In the illustrative multiparameter lights 100 and 200 of FIGS. 9 and 10 respectively, the logic is a programmable general purpose microprocessor or controller in the control system 112. The control signal for the mechanical strobe is a signal to the shutter motor 162 that controls the time during which the shutter 163 is in a darkness sustaining position. The control signal for the electronic strobe is a signal to the variable power supply 114 that controls the power to the lamp 154. At slow to moderate flash repetition rates, the mechanical strobe alone is operated to obtain a stroboscopic effect as represented by waveforms 300 and 400 of FIGS. 11 and 12. Alternatively, if enhanced strobe contrast is desired, the mechanical strobe and the electronic strobe are operated together to obtain a stroboscopic effect as represented by waveform 800 in FIG. 16. At fast flash repetition rates, the electronic strobe alone is operated to obtain a stroboscopic effect as represented by waveform 600 in FIG. 14, which is superior to the stroboscopic effect from the mechanical strobe as represented by waveform 500 of FIG. 13. At even faster flash repetition rates, the electronic strobe is operated using a reduced low operating power level (e.g. level 702 in FIG. 15) to obtain a fast stroboscopic effect with improved strobe contrast, as represented by waveform 700 of FIG. 15. It will be appreciated that these various stroboscopic effects are illustrative, and that a variety of other stroboscopic effects can be achieved by varying the darkness sustain period and the light sustaining period of the mechanical strobe, by varying the duration of high power operation and duration of low power operation of the electronic strobe, and by combining the stroboscopic effects of the mechanical and electronic strobes in various ways.

Under the DMX protocol, one channel has 256 discrete control values. An example of illustrative DMX values on a single strobe control channel is as follows. Control Value 0 through 4 represent commands to open the mechanical shutter (no strobe). Control Value 5 through 50 represent commands to combine mechanical strobing and electronic strobing for the optimum contrast ratio. The Control Value of 5 means 1 flash every 5 seconds, while higher control values mean a greater number of flashes per second. A control value of 50 means 5 flashes per second. Five flashes per second is approximately the point in our example at which the performance of combined mechanical and electronic strobing is visually similar to the performance of electronic strobing only. Beyond this point, electronic strobing outperforms mechanical strobing and combined mechanical and electronic strobing, and provides even greater performance as the strobe rate increases. Control Value 51 through 100 represent commands to perform electronic strobing. The Control Value of 51 means 5.1 flashes per second, while higher control values mean a greater number of flashes per second. For example, a control value of 100 means 20 flashes per second.

The remaining control values (256 minus the 100 described above) may be used to control a variety of different stroboscopic effects, as is generally known in the art. For example, the strobe control channel may command several other types of strobe attributes where the mechanical shutter may act differently when it acts to block and unblock the light beam. For instance, it may slowly cut across the light beam to shut off the light beam slowly but when it moves to allow the light beam to pass it opens up at its full speed. This is called a ramp down effect. Another effect is the ramp up effect, which is a mechanical shutter action to achieve a slow ramp up from maximum darkness level to full intensity with a quick shut off. The strobe control channel may command variations of mechanical strobe functions that are called up by varying the value of the strobe control channel.

Alternatively or additionally, some of the remaining control values may be used to control a variety of novel stroboscopic effects made possible by the ability to combine electronic and mechanical stroboscopic effects as well as the ability to use electronic strobing where only conventional mechanical strobing was previously used. For example, electronic strobing may be used to provide slow ramp up and slow ramp down having a different visual impact than that of mechanical strobing. A combination of electronic strobing and mechanical strobing may be used to obtain bursts of extremely fast flashes (fast electronic strobing with the mechanical shutter open) separated by intervals of complete darkness (mechanical shutter closed).

Figure 17:
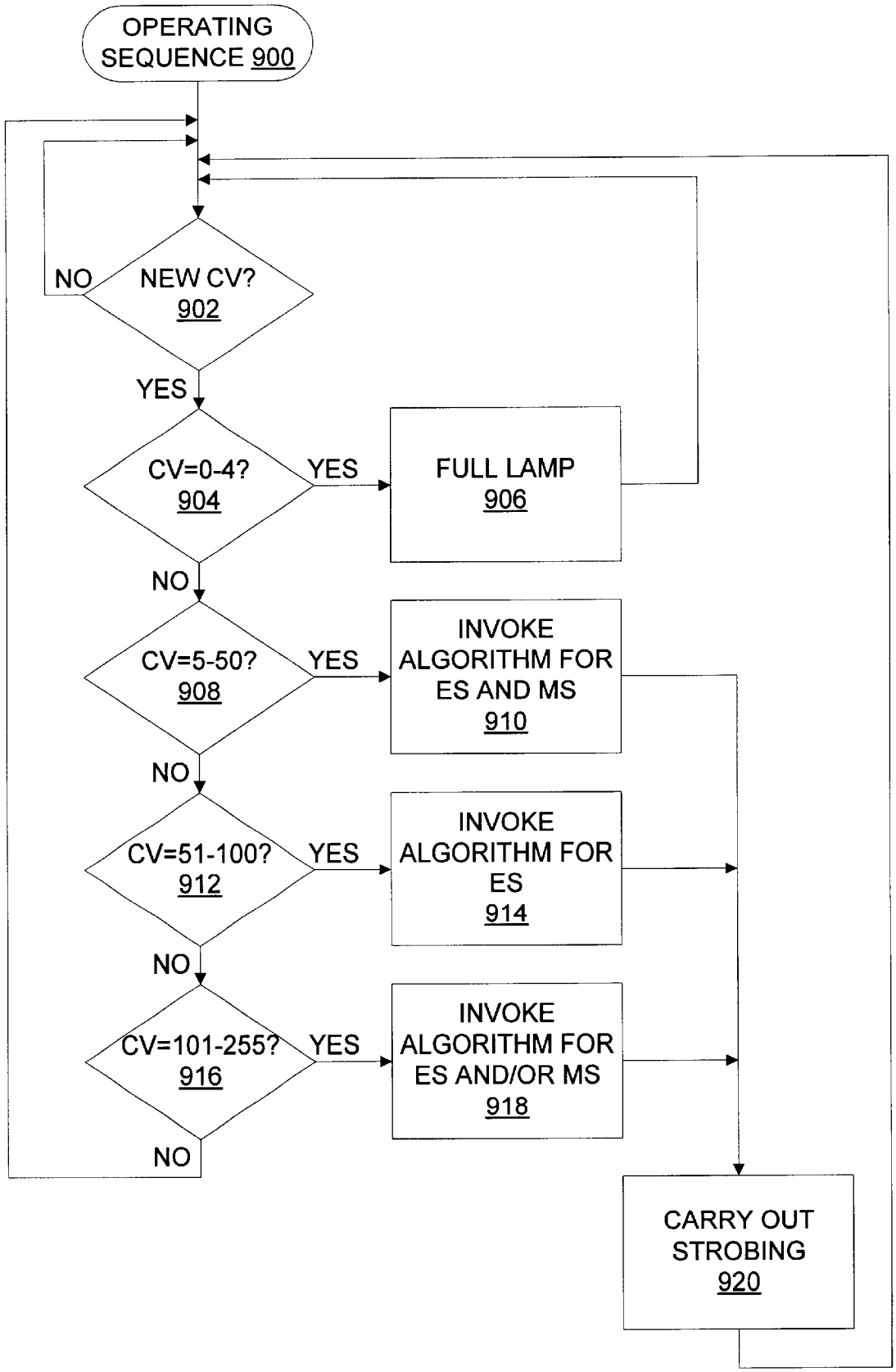
FIG. 17 is a flowchart of a method of operating the multiparameter light of FIGS. 9 and 10 to obtain a stroboscopic effect.

An illustrative operating sequence 900 for strobing the multiparameter lights 100 and 200 of FIGS. 9 and 10 is shown in FIG. 17. The control system 112 (FIGS. 9 and 10) monitors for a new control value on the DMX strobe control channel (block 902—no). When a new control value is detected, the microprocessor in the control system 112 may not invoke any strobing algorithm for some control values, or may invoke an algorithm for operating the mechanical strobe if the control value represents a mechanical strobing operation, an algorithm for operating the electronic strobe if the control value represents an electronic strobing operation, or an algorithm for operating both the mechanical and electronic strobes if the control value represents a coordinated strobing operation. For example, a control value of say 0 to 4 (block 904—yes) indicates full lamp operation (block 906), in which the shutter is placed in an open position and the lamp is operated at full power. No stroboscopic effect is produced. A control value of, for example, 5 to 50 (block 908—yes) indicates combined mechanical and electronic strobing, so that an algorithm is invoked for operating both the electronic and mechanical strobes in accordance with the control values to achieve optimized sharp contrast (block 910). A control value of, for example, 51 to 100 (block 912—yes) indicates electronic strobing, so that an algorithm is invoked for operating the electronic strobe in accordance with the control values (block 914). A control value of, for example, 101 to 255 (block 916—yes) indicates other stroboscopic effects, so that an algorithm is invoked for operating the electronic and mechanical strobes either separately or together in accordance with the control values to achieve the desired other stroboscopic effect (block 918). Other stroboscopic effects include timing alterations such as slow ramp up or slow ramp down. The algorithms are invoked in any convenient manner, as by consulting a look up table based on the control value, executing a subroutine or program call or program object based on the control value, and so forth. Once the algorithms are invoked, strobing is carried out under control of the microprocessor in the control system 112 (block 920).

Figure 18:
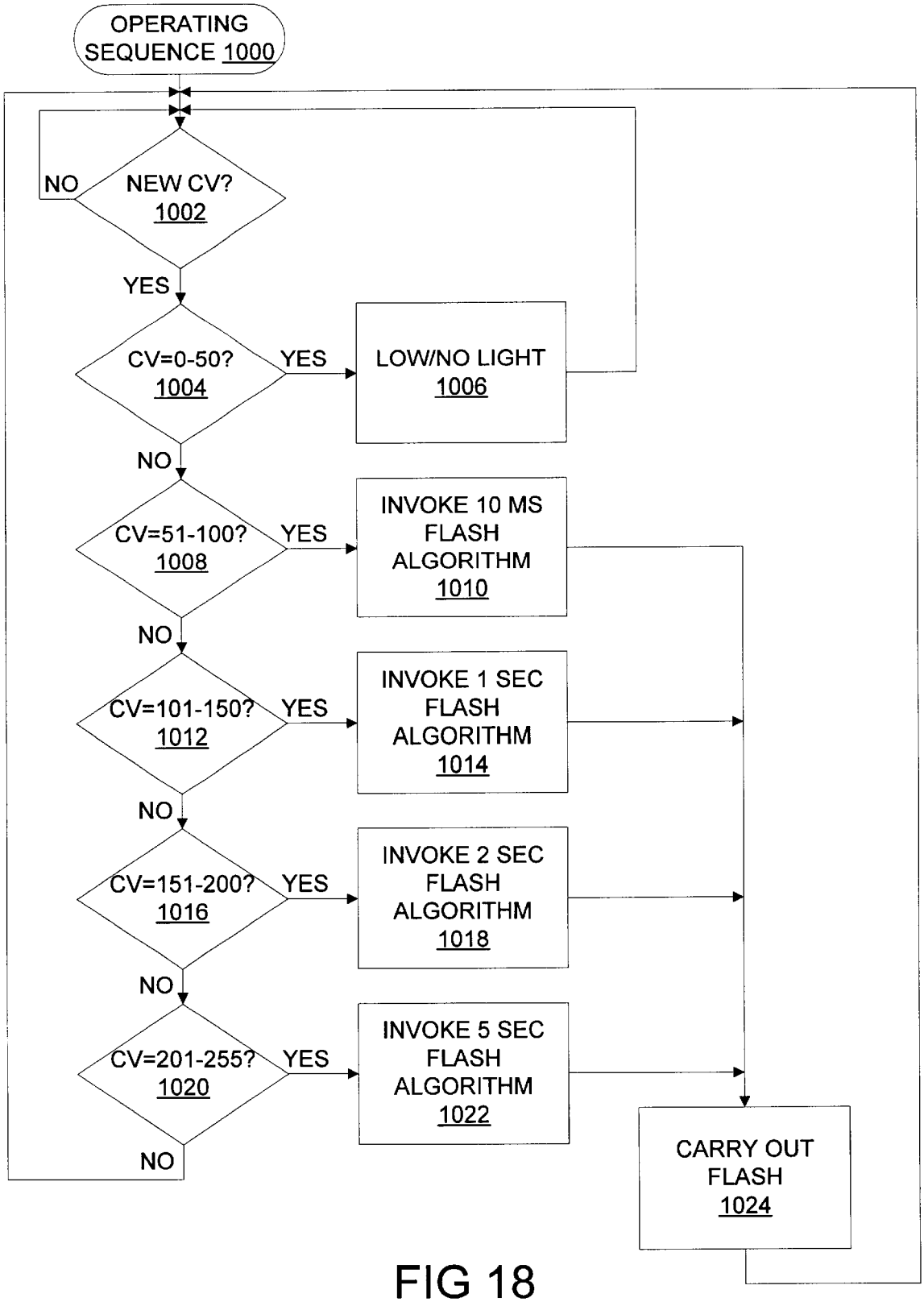
FIG. 18 is a flowchart of a method of operating the multiparameter light of FIGS. 9 and 10 to obtain a flash.

An illustrative operating sequence 1000 for operating the multiparameter lights 100 and 200 of FIGS. 9 and 10 to achieve under operator control a single flash or a series of flashes is shown in FIG. 18. Since each flash is individually specified, a series of flashes may include flashes of different characteristics. An operator may specify a series of flashes of the same or different characteristics over a relatively short period of time to create a stroboscopic effect or other special effect, as desired. The multiple flashes are produced as individual control values are received (block 1002—yes) and lead to the production of respective flashes (block 1024).

The control system 112 (FIGS. 9 and 10) monitors for a new control value on the DMX flash control channel (block 1002—no). A new control value may be for another flash, or may in effect reset the channel for another flash control value by having a value in the 0–50 range. When a new control value is detected (block 1002—yes), the microprocessor in the control system 112 may not invoke any flash algorithm for some control values, or may invoke an algorithm for operating the mechanical shutter if the control value represents a mechanical flash operation, an algorithm for varying lamp intensity if the control value represents an electronic flash operation, or an algorithm for operating both the mechanical shutter and varying lamp intensity if the control value represents a coordinated mechanical/electrical flash operation.

An example of how a DMX control channel may be set up for controlling flashes using both the mechanical shutter and varied lamp intensity as shown below in Table 1. For clarity, only four different flashes are defined in Table 1, and different DMX control values over a range are used to control identically each one of the flashes. In practice, the DMX control channel may be used to control many more flashes, or DMX control channel space may be better utilized by using the same DMX control channel to control other types of flashes or even other parameters. The type of flash defined in Table 1 is identical to the type of flash shown in FIG. 16, the basic difference being that the individual flashes defined in Table 1 are directly specified with a DMX control value rather than indirectly as part of a series of flashes specified by a DMX control value.

TABLE 1

| DMX CONTROL VALUE | FUNCTION |
|---|---|
| 0–50 | Shutter closed and lamp intensity at low level. |
| 51–100 | Shutter opens with lamp intensity at low level; lamp intensity goes to a high level for 10 milliseconds; lamp intensity returns to low level; shutter closes |
| 101–150 | Shutter opens with lamp intensity at a low level; lamp intensity goes to a high level for 1 second and returns to a low level; shutter closes |
| 151–200 | Shutter opens with lamp intensity at a low level; lamp intensity goes to a high level for 2 seconds and returns to a low level; shutter closes |
| 201–255 | Shutter opens with lamp intensity at a low level; lamp intensity goes to a high level for 5 seconds and returns to a low level; shutter closes |

An example of how a DMX control channel may be set up for controlling flashes using only varied lamp intensity as shown below in Table 2. For clarity, only four different flashes are defined in Table 1, and different DMX control values over a range are used to control identically each one of the flashes. In practice, the DMX control channel may be used to control many more flashes, or DMX control channel space may be better utilized by using the same DMX control channel to control other types of flashes or even other parameters. The type of flash defined in Table 2 is identical to the type of flash shown in, for example, FIG. 14 or FIG. 15, the basic difference being that the individual flashes defined in Table 2 are directly specified with a DMX control value rather than indirectly as part of a series of flashes specified by a DMX control value.

TABLE 2

| DMX CONTROL VALUE | FUNCTION |
|---|---|
| 0–50 | Lamp intensity at a low level |
| 51–100 | Lamp intensity begins at a low level, goes to a high level for 10 milliseconds, then returns to a low level |
| 101–150 | Lamp intensity begins at a low level, goes to a high level for 1 second, then returns to a low level |
| 151–200 | Lamp intensity begins at a low level, goes to a high level for 2 seconds, then returns to a low level |
| 201–255 | Lamp intensity begins at a low level, goes to a high level for 5 seconds, then returns to a low level |

The operating sequence 1000 of FIG. 18 is now explained in detail with reference to, for example, the control values set forth in Tables 1 and 2. A control value of say 0 to 50 (block 1004—yes) indicates a dark interval (block 1006) in which light is low or blocked entirely. No flash is produced. A control value of, for example, 51 to 100 (block 1008—yes) indicates a 10 millisecond flash and a suitable algorithm such as that described in Table 1 or Table 2 is invoked (block 1010). A control value of, for example, 101 to 150 (block 1012—yes) indicates a 1 second flash and a suitable algorithm such as that described in Table 1 or Table 2 is invoked (block 1014). A control value of, for example, 151 to 200 (block 1016—yes) indicates a 2 second flash and a suitable algorithm such as that described in Table 1 or Table 2 is invoked (block 1018). A control value of, for example, 201 to 255 (block 1020—yes) indicates a 5 second flash and a suitable algorithm such as that described in Table 1 or Table 2 is invoked (block 1022). The algorithms are invoked in any convenient manner, as by consulting a look up table based on the control value, executing a subroutine or program call or program object based on the control value, and so forth. Once the algorithms are invoked, the flash is carried out under control of the microprocessor in the control system 112 (block 1024).

The operator may select flashes from a fraction of a second to several seconds. Preferably to enhance contrast, the flash is formed by operating the lamp at a low intensity level using less power to the lamp than the minimum rated power level, then instantly operating the lamp at a high intensity level using more power to the lamp than the maximum rated power level, then instantly operating the lamp at a low intensity level using less power to the lamp than the minimum rated power level. The lamp should remain at the lower power level for sufficient time before it is allowed to flash again to maintain an average duty cycle so that the lamp does not run at an overall power level in excess of the recommended maximum operating power level. Preferably, the microprocessor in the multiparameter light considers the duration of the last flash and prevents another flash from occurring until adequate time is allowed for the lamp to operate at the lowest power level and reduce the temperature of the lamp.

If desired, a flash may be formed without having the upper power level to the lamp exceed the maximum rated power level and the lower power to the lamp being less than the minimum rated power level. In this event, duty cycle control would not be needed.

Figure 19:
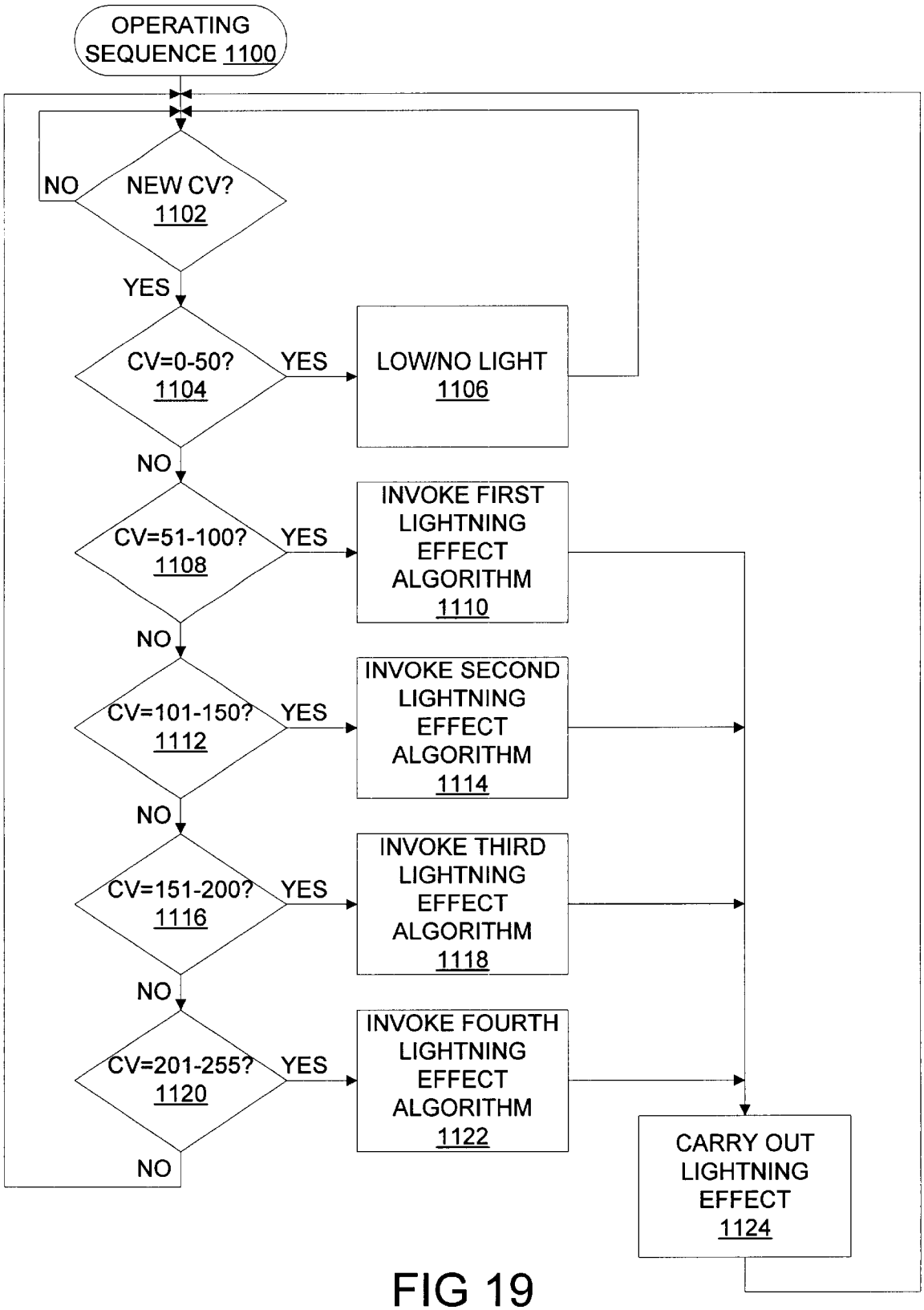
FIG. 19 is a flowchart of a method of operating the multiparameter light of FIGS. 9 and 10 to obtain a lightning effect.

FIG. 19 shows an illustrative operating sequence 1100 for operating the multiparameter lights 100 and 200 of FIGS. 9 and 10 to achieve a lightning effect. The lightning effect is achieved essentially by simulating the visual times associated with lightning. The control system 112 (FIGS. 9 and 10) monitors for a new control value on the DMX lightning control channel (block 1102—no). A new control value may be for another lightning effect, or may in effect reset the channel for another lightning effect control value by having a value in the 0–50 range. When a new control value is detected (block 1102—yes), the microprocessor in the control system 112 invokes an algorithm for creating a particular lightning effect by varying the lamp intensity with or without the use of the mechanical shutter and leads to the production of an appropriate lightning effect (block 1124).

An example of how a DMX control channel may be set up for controlling a lightning effect using both the mechanical shutter and varied lamp intensity as shown below in Table 3. For clarity, only four different lightning effects are defined in Table 3, and different DMX control values over a range are used to control identically each one of the lightning effects. In practice, the DMX control channel may be used to control many more lightning effects, or DMX control channel space may be better utilized by using the same DMX control channel to control other types of flashes or even other parameters.

TABLE 3

| DMX CONTROL VALUE | FUNCTION |
|---|---|
| 0–50 | Shutter closed and lamp intensity at a low level |
| 51–100 | Shutter opens with lamp intensity at a low level; lamp intensity goes to a high level for 100 milliseconds; lamp intensity goes to the low level for 1 second; lamp intensity goes to the high level for 1 second; lamp intensity goes to an intermediate intensity for 500 milliseconds; lamp intensity goes to the low level; shutter closes |
| 101–150 | Shutter opens with lamp intensity at a low level; lamp intensity goes to a high level for 300 milliseconds; lamp intensity goes to the low level for 500 milliseconds; lamp intensity goes to the high level for 1.5 seconds; lamp intensity goes to an intermediate intensity for 100 milliseconds; lamp intensity goes to the low level; shutter closes |
| 151–200 | Shutter opens with lamp intensity at a low level; lamp intensity goes to a high level for 1 second; lamp intensity goes to the low level for 2 seconds; lamp intensity goes to the high level for 200 milliseconds; lamp intensity goes to an intermediate intensity for 2 seconds; lamp intensity goes to the low level; shutter closes |
| 201–255 | Shutter opens with lamp intensity at a low level; lamp intensity goes to a high level for 3 seconds; lamp intensity goes to the low level for 1 second; lamp intensity goes to the high level for 2 seconds; lamp intensity goes to an intermediate intensity for 500 milliseconds; lamp intensity goes to the low level; shutter closes |

An example of how a DMX control channel may be set up for controlling a lightning effect using only varied lamp intensity as shown below in Table 4. For clarity, only four different lightning effects are defined in Table 4, and different DMX control values over a range are used to control identically each one of the lightning effects. In practice, the DMX control channel may be used to control many more lightning effects, or DMX control channel space may be better utilized by using the same DMX control channel to control other types of flashes or even other parameters.

TABLE 4

| DMX CONTROL VALUE | FUNCTION |
|---|---|
| 0–50 | Lamp intensity at a low level |
| 51–100 | lamp intensity goes to a high level for 100 milliseconds; lamp intensity goes to the low level for 1 second; lamp intensity goes to the high level for 1 second; lamp intensity goes to an intermediate intensity for 500 milliseconds; lamp intensity goes to the low level |
| 101–150 | lamp intensity goes to a high level for 300 milliseconds; lamp intensity goes to the low level for 500 milliseconds; lamp intensity goes to the high level for 1.5 seconds; lamp intensity goes to an intermediate intensity for 100 milliseconds; lamp intensity goes to the low level |
| 151–200 | intensity goes to a high level for 1 second; lamp intensity goes to the low level for 2 seconds; lamp intensity goes to the high level for 200 milliseconds; lamp intensity goes to an intermediate intensity for 2 seconds; lamp intensity goes to the low level |
| 201–255 | lamp intensity goes to a high level for 3 seconds; lamp intensity goes to the low level for 1 second; lamp intensity goes to the high level for 2 seconds; lamp intensity goes to an intermediate intensity for 500 milliseconds; lamp intensity goes to the low level |

The operating sequence 1100 shown in FIG. 19 is now explained in detail with reference to, for example, the control values set forth in Tables 3 and 4. A control value of say 0 to 50 (block 1104—yes) indicates a dark interval (block 1106), in which light is low or blocked entirely. No lightning effect is produced. A control value of, for example, 51 to 100 (block 1108—yes) indicates one type of lightning effect and a suitable algorithm such as that described in Table 3 or Table 4 is invoked (block 1110). A control value of, for example, 101 to 150 (block 1112—yes) indicates another type of lightning effect and a suitable algorithm such as that described in Table 3 or Table 4 is invoked (block 1114). A control value of, for example, 151 to 200 (block 1116—yes) indicates yet another type of lightning effect and a suitable algorithm such as that described in Table 3 or Table 4 is invoked (block 1118). A control value of, for example, 201 to 255 (block 1120—yes) indicates yet another type of lightning effect and a suitable algorithm such as that described in Table 3 or Table 4 is invoked (block 1122). The algorithms are invoked in any convenient manner, as by consulting a look up table based on the control value, executing a subroutine or program call or program object based on the control value, and so forth. Once the algorithms are invoked, the lightning effect is carried out under control of the microprocessor in the control system 112 (block 1124).

In principle, the lightning effect is achieved by ramping up the lamp intensity and then erratically ramping up and down to simulate the visual light durations of lighting. Preferably to enhance contrast and hence realism, the high level of light intensity is produced using more power to the lamp than the maximum rated power level, and the low level of light intensity is produced using less power to the lamp than the minimum rated power level. However, care is taken so that the lamp does not run at an average operating power level in excess of the recommended maximum operating power level. The lamp should remain at the medium and/or lower power levels for sufficient time during and after a particular lightning effect to maintain the average duty cycle so that the lamp does not run at an overall power level in excess of the recommended maximum operating power level. Preferably, the microprocessor in the multiparameter light considers the operating power levels within and after a lightning effect and prevents another lightning effect from occurring until adequate time is allowed for the lamp to operate at the lowest power level and reduce the temperature of the lamp.

If desired, a lightning effect may be simulated without having the upper power level to the lamp exceed the maximum rated power level and/or the lower power level to the lamp being less than the minimum rated power level. In this event, duty cycle control would not be needed.

The description of the invention and its applications as set forth herein is illustrative and is not intended to limit the scope of the invention as set forth in the following claims. Variations and modifications of the embodiments disclosed herein are possible, and practical alternatives to and equivalents of the various elements of the embodiments are known to those of ordinary skill in the art. These and other variations and modifications of the embodiments disclosed herein may be made without departing from the scope and spirit of the invention.

What is claimed is:

1. A method of operating a multiparameter light having a control system, a shutter and an arc lamp to obtain a stroboscopic effect, comprising:

operating the shutter over a first plurality of cycles to obtain flashes at a first frequency, under control of the control system; and applying a first operating power and a second operating power alternately to the arc lamp over a second plurality of cycles to obtain flashes at a second frequency, under control of the control system.

2. A method as in claim 1 wherein the first frequency is substantially constant and the second frequency is substantially constant.

3. A method as in claim 1 wherein first frequency is variable and the second frequency is variable.

4. A method as in claim 3 further comprising:

varying time between the first flashes to vary the first frequency; and varying time between the second flashes to vary the second frequency.

5. A method as in claim 3 further comprising:

varying durations of the first flashes to vary the first frequency; and varying durations of the second flashes to vary the second frequency.

6. A method as in claim 1 wherein first frequency is substantially constant and the second frequency is variable.

7. A method as in claim 1 wherein first frequency is variable and the second frequency is substantially constant.

8. A method as in claim 1 further comprising:

receiving a first command signal at the control system at a first time, the operating step being under control of the control system in response to the first command signal; and receiving a second command signal at the control system at a second time different from the first time, the applying step being under control of the control system in response to the second command signal;

wherein the second frequency is greater than the first frequency and the second plurality of cycles is discrete from the first plurality of cycles.

9. A method as in claim 8 wherein:

the arc lamp has a minimum rated power level; and the second operating power is about equal to the minimum rated power level of the arc lamp.

10. A method as in claim 9 further comprising operating the lamp at a third operating power over the first plurality of cycles, wherein:

the arc lamp has a maximum rated power level;

the third operating power is about equal to the maximum rated power level of the arc lamp; and the first operating power is about equal to the maximum rated power level of the arc lamp.

11. A method as in claim 8 wherein:

the arc lamp has a minimum rated power level; and an average of the first operating power plus the second operating power over the second plurality of cycles is not less than about the minimum rated power level of the arc lamp.

12. A method as in claim 11 further comprising operating the lamp at a third operating power over the first plurality of cycles, wherein:

the arc lamp has a maximum rated power level;

the third operating power is about equal to the maximum rated power level of the arc lamp; and the first operating power is about equal to the maximum rated power level of the arc lamp.

13. A method as in claim 1 further comprising receiving a first command signal at the control system at a first time, the operating step and the applying step being under control of the control system in response to the first command signal; wherein the first frequency and the second frequency are essentially equal and the first plurality of cycles is essentially coincident with the second plurality of cycles.

14. A method as in claim 13 wherein:

the arc lamp has a minimum rated power level; and the second operating power is about equal to the minimum rated power level of the arc lamp.

15. A method as in claim 14 wherein:

the arc lamp has a maximum rated power level; and the first operating power is about equal to the maximum rated power level of the arc lamp.

16. A method as in claim 13 wherein:

the arc lamp has a minimum rated power level; and an average of the first operating power plus the second operating power over the second plurality of cycles is not less than about the minimum rated power level of the arc lamp.

17. A method as in claim 16 wherein:

the arc lamp has a maximum rated power level; and the first operating power is about equal to the maximum rated power level of the arc lamp.

18. A method as in claim 13 further comprising:

receiving a second command signal at the control system at a second time different from the first time; and applying a third operating power and a fourth operating power alternately to the arc lamp over a third plurality of cycles to obtain flashes at a third frequency, under control of the control system in response to the second command signal;

wherein the third frequency is greater than the first frequency and is greater than the second frequency, and the third plurality of cycles is discrete from the first and second plurality of cycles.

19. A method as in claim 18 wherein:

the arc lamp has a minimum rated power level;

the third operating power is greater than the fourth operating power; and the fourth operating power is about equal to the minimum rated power level of the arc lamp.

20. A method as in claim 19 wherein:

the arc lamp has a maximum rated power level; and the third operating power is about equal to the maximum rated power level of the arc lamp.

21. A method as in claim 18 wherein:

the arc lamp has a minimum rated power level;

the third operating power is greater than the fourth operating power; and an average of the third operating power plus the fourth operating power over the second plurality of cycles is not less than about the minimum rated power level of the arc lamp.

22. A method as in claim 21 wherein:

the arc lamp has a maximum rated power level; and the third operating power is about equal to the maximum rated power level of the arc lamp.

23. A method as in claim 1 wherein the arc lamp is a mercury lamp.

24. A method as in claim 1 wherein the arc lamp is a metal halide lamp.

25. A method as in claim 1 wherein the arc lamp is a Xenon lamp.

26. A method of operating a multiparameter light to obtain a stroboscopic effect, the multiparameter light having a shutter and a mercury-filled lamp powered by a variable power supply, and the mercury-filled lamp having a maximum rated power level and a minimum rated power level, comprising:

determining a high operating power for the mercury-filled lamp;

determining a low operating power forte mercury-filled lamp;

determining a first duration over which to apply the high operating power to the mercury-filled lamp;

determining a second duration over which to apply the low operating power to the mercury-filled lamp; and alternately applying the high operating power for the first duration and the low operating power for the second duration to the mercury-filled lamp over a plurality of cycles to obtain flashes having a desired frequency and duration, wherein the shutter is open for at least a portion of each of the flashes;

wherein the high operating power determining step, the low operating power determining step, the first duration determining step, and the second duration determining step result in an average power during the applying step of between about the maximum rated power level and about the minimum rated power level of the mercury-filled lamp.

27. A method as in claim 26 further comprising the step of varying the desired frequency by varying the second duration while maintaining the first duration constant.

28. A method as in claim 26 further comprising the step of varying the desired frequency by varying the first duration while maintaining the second duration constant.

29. A method as in claim 26 further comprising the step of varying the desired frequency by varying the first and second durations.

30. A method as in claim 26 wherein the low operating power for the mercury-filled lamp is about equal to the minimum rated power level of the mercury-filled lamp.

31. A method as in claim 26 wherein an average of the high operating power plus the low operating power in the applying step is about equal to the maximum rated power level of the mercury-filled lamp.

32. A method as in claim 26 wherein the mercury-filled lamp comprises high pressure mercury vapor.

33. A method as in claim 26 wherein the mercury-filled lamp comprises mercury vapor in combination with at least one metal halide.

34. A method as in claim 26 wherein the multiparameter light further has a mechanical shutter, further comprising maintaining the mechanical shutter in an open position during the applying step.

35. A multiparameter light comprising:

an arc lamp;

a variable power supply coupled to the arc lamp;

a shutter; and a control system having an output coupled to the shutter for operating the shutter to obtain a stroboscopic effect, and an output coupled to the variable power supply for operating the arc lamp to obtain a stroboscopic effect.

36. A multiparameter light as in claim 35 wherein the arc lamp is a mercury lamp.

37. A multiparameter light as in claim 35 wherein the arc lamp is a metal halide lamp.

38. A multiparameter light as in claim 35 wherein the arc lamp is a Xenon lamp.

39. A multiparameter light as in claim 35 wherein the control system comprises a microcontroller.

40. A multiparameter light as in claim 35 wherein the control system comprises:

a communications input for receiving command signals over a plurality of channels, including strobe command signals; and logic for generating from the strobe command signals control signals for the shutter and for the variable power supply.

41. A multiparameter light as in claim 40 wherein the communications input receives the strobe command signals over a specific one of the plurality of channels.

42. A multiparameter light as in claim 35 wherein the control system comprises:

logic for operating the shutter to obtain a stroboscopic effect at slow strobe rates; and logic for operating the arc lamp to obtain a stroboscopic effect at fast strobe rates.

43. A multiparameter light as in claim 42 wherein the control system further comprises:

a communications input for receiving strobe command signals over a specific channel, the shutter operating logic and the arc lamp operating logic being responsive to the strobe command signals; and logic for automatically controlling transitions between operation of the shutter and operation of the arc lamp in accordance with the strobe command signals.

44. A multiparameter light as in claim 35 wherein the control system comprises:

logic for operating the shutter and the arc lamp in synchronism to obtain a stroboscopic effect at slow strobe rates; and logic for operating the arc lamp to obtain a stroboscopic effect at fast strobe rates.

45. A multiparameter light as in claim 44 wherein the control system further comprises:

a communications input for receiving strobe command signals over a specific channel, the shutter operating logic and the arc lamp operating logic being responsive to the strobe command signals; and logic for automatically controlling transitions between synchronized operation of the shutter and the arc lamp and operation of the arc lamp in accordance with the strobe command signals.

46. A multiparameter light as in claim 35 wherein the control system comprises logic for operating the arc lamp to obtain a series of flashes.

47. A multiparameter light as in claim 46 wherein the control system comprises logic for opening the shutter as the series of flashes begins and for closing the shutter as the series of flashes ends.

48. A multiparameter light as in claim 35 wherein the control system comprises logic for operating the arc lamp to obtain a lightning effect.

49. A multiparameter light as in claim 48 wherein the control system comprises logic for opening the shutter as the lightning effect begins and for closing the shutter as the lightning effect ends.

50. A multiparameter light comprising:

a shutter;

an arc lamp;

a variable power supply coupled to the arc lamp; and a control system having an output coupled to the variable power supply for operating the arc lamp to obtain a series of flashes, and an output coupled to the shutter for opening the shutter for at least a portion of each of the flashes.

51. A multiparameter light as in claim 50 wherein the control system comprises:

means for controlling a high operating power and a low operating power by the variable power supply at a particular duty cycle; and means for setting the low operating power at a minimum level necessary to maintain the arc lamp in a good operating condition as a function of the duty cycle.

52. A multiparameter light as in claim 51 wherein the arc lamp is a mercury-filled lamp.

53. A multiparameter light as in claim 52 wherein the mercury-filled lamp comprises mercury vapor in combination with at least one metal halide.

54. A multiparameter light as in claim 50 wherein the arc lamp has a minimum rated power level and wherein the control system further comprises means for setting the low operating power at about a level for which an average of the high operating power plus the low operating power is not less than about the minimum rated power level of the arc lamp.

55. A multiparameter light as in claim 54 wherein the arc lamp is a mercury-filled lamp.

56. A multiparameter light as in claim 55 wherein the mercury-filled lamp comprises mercury vapor in combination with at least one metal halide.

57. A method of operating a multiparameter light, the multiparameter light including at least an arc lamp having a maximum rated power level, a shutter, and a control system, the method comprising:

applying operating power to the arc lamp less than the maximum rated power level;

generating with the control system in response to a command signal a plurality of lamp power control signals; and after the step of applying operating power to the arc lamp less than the maximum rated power level and in response to the lamp power control signals, applying operating power to the arc lamp greater than the maximum rated power level over a first duration and less than the maximum rated power level over a second duration to generate a flash.

58. A method as in claim 57 further comprising:

generating with the control system a plurality of shutter control signals in response to the command signal; and in response to the shutter control signals, operating the shutter in coordination with the step of applying operating power to generate the flash.

59. A method as in claim 57 wherein:

the arc lamp has a minimum rated power level; and the average of the operating power applied over the first and second durations in the step of applying operating power to generate the flash is between about the minimum rated power level and the maximum rated power level of the arc lamp.

60. A method as in claim 57 wherein:

the arc lamp has a minimum rated power level; and the step of applying operating power to generate the flash comprises applying operating power to the arc lamp less than the minimum rated power level over the second duration.

61. A method as in claim 57 further comprising performing the step of applying operating power to generate a flash, for a plurality of times and in rapid succession to generate a series of flashes, wherein operating power greater than the maximum rated power level is applied over a plurality of first durations and operating power less than the maximum rated power level is applied over a plurality of second durations, the first and second durations alternating.

62. A method as in claim 61 further comprising:

generating with the control system a plurality of shutter control signals in response to the command signal; and in response to the shutter control signals, operating the shutter relative to generation of the series of flashes to realize a series of flashes from the multiparameter light that create a stroboscopic effect.

63. A method as in claim 61 wherein the arc lamp has a minimum rated power level; further comprising establishing the operating power applied over the first and second durations and the lengths of the first and second durations so that the average of the operating power applied over the first and second durations is between about the minimum rated power level and the maximum rated power level of the arc lamp.

64. A method as in claim 61 wherein:

the arc lamp has a minimum rated power level; and the step of applying operating power to generate a flash comprises applying operating power to the arc lamp less than the minimum rated power level over the second durations.

65. A method as in claim 61 wherein the first durations are of an equal length and the second durations are of an equal length.

66. A method as in claim 61 wherein the first durations are of a varying length and the second durations are of an equal length.

67. A method as in claim 61 wherein the first durations are of an equal length and the second durations are of a varying length.

68. A method as in claim 61 wherein the first durations are of a varying length and the second durations are of a varying length.

69. A method as in claim 61 further comprising:

applying operating power to the arc lamp less than the maximum rated power over a third interval between the first and second interval for at least one of the flashes to generate multiple intensity levels therein and to realize a lightning effect with the series of flashes.

70. A method as in claim 69 wherein the arc lamp has a minimum rated power level; further comprising establishing the operating power applied over the first, second and third durations and the lengths of the first, second and third durations so that the average of the operating power applied over the first, second and third durations is between about the minimum rated power level and the maximum rated power level of the arc lamp.

71. A method of operating a multiparameter light having at least a shutter and an arc lamp having a maximum rated power level, comprising:

applying operating power to the arc lamp less than the maximum rated power level;

after the step of applying operating power to the arc lamp less than the maximum rated power level, applying operating power to the arc lamp greater than the maximum rated power level over a first duration and less than the maximum rated power level over a second duration to generate a flash; and operating the shutter in coordination with the step of applying operating power to generate the flash.

72. A method as in claim 71 wherein the flash has a predetermined shape and the step of operating the shutter comprises:

opening the shutter substantially as the first duration begins; and closing the shutter substantially as the first duration ends;

wherein the predetermined shape of the flash is substantially determined by both the step of applying operating power to generate the flash and the step of operating the shutter.

73. A method as in claim 71 wherein the flash has a predetermined shape and the step of operating the shutter comprises:

opening the shutter during the first duration; and closing the shutter during the first duration;

wherein the predetermined shape of the flash is primarily determined by the step of operating the shutter.

74. A method as in claim 71 wherein the flash has a predetermined shape and the step of operating the shutter comprises:

opening the shutter prior to the first duration; and closing the shutter after the first duration;

wherein the predetermined shape of the flash is primarily determined by the step of applying operating power to generate the flash.

75. A method as in claim 71 wherein the arc lamp has a minimum rated power level; further comprising establishing the operating power applied over the first and second duration and the length of the first duration and the length of the second duration so that the average of the operating power applied over the first and second durations is between about the minimum rated power level and the maximum rated power level of the arc lamp.

76. A method as in claim 71 wherein:

the arc lamp has a minimum rated power level; and the step of applying operating power to generate a flash comprises applying operating power to the arc lamp less than the minimum rated power level over the second duration.

77. A method as in claim 71 further comprising controlling the step of applying operating power to generate a flash and the step of operating the shutter with a control system in the multiparameter light.

78. A method as in claim 71 wherein the flash has a generally uniform intensity level.

79. A method as in claim 71 wherein the flash has a plurality of intensity levels.

80. A method as in claim 71 wherein the arc lamp is a mercury lamp.

81. A method as in claim 71 wherein the arc lamp is a metal halide lamp.

82. A method as in claim 71 wherein the arc lamp is a Xenon lamp.

83. A method as in claim 71 further comprising performing the step of applying operating power to generate the flash for a plurality of times to generate a series of flashes that create a stroboscopic effect; wherein:

the shutter operating step comprises operating the shutter in coordination with the step of applying operating power to generate the flash, to generate the series of flashes; and operating power greater than the maximum rated power level is applied over a plurality of first durations and operating power less than the maximum rated power level is applied over a plurality of second durations, the first and second durations alternating.

84. A method as in claim 83 wherein each of the flashes has a predetermined shape, and the step of operating the shutter comprises:

opening the shutter substantially as each of the first durations begins; and closing the shutter substantially as each of the first durations ends;

wherein the predetermined shape of the flashes is substantially determined by both the step of applying operating power to generate the flash and the step of operating the shutter.

85. A method as in claim 83 wherein each of the flashes has a predetermined shape, and the step of operating the shutter comprises:

opening the shutter during each of the first durations; and closing the shutter during each of the first durations;

wherein the predetermined shape of the flashes is primarily determined by the step of operating the shutter.

86. A method as in claim 83 wherein each of the flashes has a predetermined shape, and the step of operating the shutter comprises:

opening the shutter prior to the plurality of first durations; and closing the shutter after the plurality of first durations;

wherein the predetermined shape of the flashes is primarily determined by the step of applying operating power to generate the flash.

87. A method as in claim 83 wherein the arc lamp has a minimum rated power level, further comprising establishing the operating power applied over the first and second durations and the lengths of the first and second durations so that the average of the operating power applied over the first and second durations is between about the minimum rated power level and the maximum rated power level of the arc lamp.

88. A method as in claim 83 wherein:

the arc lamp has a minimum rated power level; and the step of applying operating power to generate a flash comprises applying operating power to the arc lamp less than the minimum rated power level over the second durations.

89. A method as in claim 83 wherein the first durations are of an equal length and the second durations are of an equal length.

90. A method as in claim 83 wherein the first durations are of a varying length and the second durations are of an equal length.

91. A method as in claim 83 wherein the first durations are of an equal length and the second durations are of a varying length.

92. A method as in claim 83 wherein the first durations are of a varying length and the second durations are of a varying length.

93. A method of operating a multiparameter light, the multiparameter light having a shutter and a mercury-filled lamp powered by a variable power supply, and the mercury-filled lamp having a maximum rated power level and a minimum rated power level, comprising:

determining a high operating power for the mercury-filled lamp greater than the maximum rated power level;

determining a low operating power for the mercury-filled lamp less than the minimum rated power;

applying various operating powers, including the high operating power and the low operating power, over various time intervals to the mercury-filled lamp to obtain a plurality of flashes; and determining an average power of the various operating powers applied over the various time intervals to the mercury-filled lamp in the applying step;

wherein the high operating power determining step and the low operating power determining step are based on maintaining the average power not greater than about the maximum rated power level, and on maintaining the average power not less than about the minimum rated power level.

94. A method as in claim 93 wherein the operating power applying step comprises applying the various operating powers to the mercury-filled lamp to realize a stroboscopic effect.

95. A method as in claim 94 wherein the operating power applying step comprises applying the various operating powers to the mercury-filled lamp to generate a plurality of light intensity levels in at least one of the flashes, wherein a lightning effect is realized.

96. A multiparameter light comprising:

a shutter;

a mercury-filled lamp;

a variable power supply coupled to the mercury-filled lamp; and a control system having an output coupled to the variable power supply for operating the mercury-filled lamp at various power levels over various durations to obtain flashes of varying duration and intensity and to obtain dark intervals of varying duration and intensity between the flashes, and an output coupled to the shutter for opening the shutter for at least a portion of each of the flashes.

97. A multiparameter light as in claim 96 wherein the control system comprises a microprocessor having a set of programmed instructions for operating the mercury-filled lamp in accordance with any of a plurality of algorithms to obtain any of a plurality of stroboscopic effects.

98. A multiparameter light as in claim 97 wherein one of the algorithms is for obtaining at least one flash having a plurality of intensities, the stroboscopic effect being a lightning effect.

99. A multiparameter light as in claim 97 wherein:

the mercury-filled lamp has a maximum rated power; and the microprocessor further has a set of programmed instructions for ensuring that an average of the power levels at which the mercury-filled lamp is operated during the stroboscopic effect is not greater than approximately the maximum rated power.

100. A multiparameter light as in claim 97 wherein:

the mercury-filled lamp has a maximum rated power and a minimum rated power; and the microprocessor further has a set of programmed instructions for ensuring that an average of the power levels at which the mercury-filled lamp is operated during the stroboscopic effect is not greater than approximately the maximum rated power and not less than approximately the minimum rated power.

101. A multiparameter light as in claim 97 wherein the control system output coupled to the variable power supply and the control system output coupled to the shutter are separate outputs of the microprocessor.

102. A multiparameter light as in claim 97 wherein the control system output coupled to the variable power supply and the control system output coupled to the shutter are a single output of the microprocessor.

* * * * *